US008532558B2

(12) United States Patent
Okada et al.

(10) Patent No.: US 8,532,558 B2
(45) Date of Patent: Sep. 10, 2013

(54) PRINTING MACHINE

(75) Inventors: Aya Okada, Ibaraki-ken (JP); Shouji Kurita, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 314 days.

(21) Appl. No.: 12/971,131

(22) Filed: Dec. 17, 2010

(65) Prior Publication Data

US 2011/0164912 A1 Jul. 7, 2011

(30) Foreign Application Priority Data

Jan. 7, 2010 (JP) ..... P2010-002026
Nov. 24, 2010 (JP) ..... P2010-261293

(51) Int. Cl.
*G03G 15/00* (2006.01)
*B41J 2/01* (2006.01)

(52) U.S. Cl.
USPC ..... 399/381; 399/388; 399/396; 347/104

(58) Field of Classification Search
USPC ..... 399/381, 388, 396
See application file for complete search history.

(56) References Cited

U.S. PATENT DOCUMENTS 5,105,229 A * 4/1992 Ozaki ..... 399/17
7,657,195 B2 * 2/2010 Kim ..... 399/36
8,121,510 B2 * 2/2012 Roppongi ..... 399/82
8,213,815 B2 * 7/2012 Matsuoka ..... 399/45
2007/0216084 A1 * 9/2007 Hashimoto ..... 271/186
2008/0095550 A1 * 4/2008 Naito et al. ..... 399/50
2008/0152365 A1 * 6/2008 Park et al. ..... 399/21
2009/0092416 A1 * 4/2009 Tao ..... 399/154
2010/0061746 A1 * 3/2010 Matsuoka ..... 399/45
2010/0156029 A1 * 6/2010 Kwak et al. ..... 271/10.13

FOREIGN PATENT DOCUMENTS

JP 61229734 A * 10/1986
JP 02012323 A * 1/1990
JP 03213370 A * 9/1991
JP 06102727 A * 4/1994
JP 08-063306 A 8/1996
JP 11035194 A * 2/1999
JP 2000255841 A * 9/2000
JP 2001296784 A * 10/2001
JP 3989208 B2 7/2007
JP 2007248482 A * 9/2007
JP 2008006740 A * 1/2008
JP 2008009216 A * 1/2008

* cited by examiner

*Primary Examiner* — Daniel J Colilla
*Assistant Examiner* — Nguyen Q Ha
(74) *Attorney, Agent, or Firm* — Nath, Goldberg & Meyer; Jerald L Meyer; Stanley N. Protigal

(57) ABSTRACT

A printing machine includes: a reception unit configured to receive image data; a printing unit configured to print on a print medium based on the image data received by the reception unit; a first paper feeding unit configured to take out and convey a print medium on a paper feed tray one by one; a second paper feeding unit configured to convey a print medium conveyed by the first paper feeding unit to the printing unit; and a print control unit configured to drive the first paper feeding unit to start conveyance of a print medium upon start of reception of the image data by the reception unit.

10 Claims, 17 Drawing Sheets

PROPR ART

PRINTING MACHINE

CROSS REFERENCE TO RELATED APPLICATION

This application is based upon and claims the benefit of priority from the prior Japanese Patent Application Nos. 2010-002026, filed on Jan. 7, 2010, and 2010-261293, filed on Nov. 24, 2010, the entire contents of which are incorporated herein by reference.

BACKGROUND OF THE INVENTION

1. Field of the Invention

The present invention relates to a printing machine which can reduce a time period required to complete printing.

2. Description of the Related Art

Recently, a printing machine has widely spread which is connected to a computer through a network, receives image data generated by the computer through the network, and performs printing based on the received data.

As a device for appropriately controlling a printing process of such printing machine, Japanese Patent No. 3989208 proposes a print control device which terminates a control operation either upon completion of all procedures in a printing process or upon detection of an error while the printing process is in progress.

Meanwhile, Japanese Unexamined Patent Application Publication No. 08-63306 discloses a printing machine configured as follows. The printing machine calculates reception time required for receiving print data of multiple pages to be received in a current session, on the bases of average reception time of print data of one page. In addition, the printing machine calculates the minimum print time required to print the multiple pages to be received in the current session on the basis of the minimum print time of one page. When the print data corresponding to the number of pages that can be received in a time by which the printing data take longer to receive than to print is stored, the printing machine starts printing the stored print data.

SUMMARY OF THE INVENTION

However, the print control device disclosed in Japanese Patent No. 3989208 and the printing machine disclosed in Japanese Unexamined Patent Application Publication No. 08-63306 start printing after reception of the print data for a first page is completed. For this reason, quite a lot of time is required before starting printing, and therefore, time for completing printing is made longer as a consequence.

An object of the present invention is to provide a printing machine which is capable of reducing a time period before starting printing and thereby reducing a time period to complete printing.

An aspect of the present invention is a printing machine comprising: a reception unit configured to receive image data; a printing unit configured to print on a print medium based on the image data received by the reception unit; a first paper feeding unit configured to take out and convey a print medium on a paper feed tray one by one; a second paper feeding unit configured to convey a print medium conveyed by the first paper feeding unit to the printing unit; and a print control unit configured to drive the first paper feeding unit to start conveyance of a print medium upon start of reception of the image data by the reception unit.

According to this aspect, the first paper feeding unit is caused to start the conveyance of the print medium when the reception unit starts receiving the image data. Hence, there is no need to wait for completion of reception of the image data by the reception unit, and a time period until starting printing is reduced. In this way, it is possible to obtain a first printed material earlier than the related art.

The printing machine may further comprise a transfer unit configured to transfer the image data received by the reception unit to the printing unit, wherein the print control unit is configured to drive the second paper feeding unit to start conveyance of a print medium upon completion of transfer of the image data corresponding to a prescribed number of lines by the transfer unit.

According to this configuration, the second paper feeding unit is caused to start conveyance of the print medium when the transfer unit completes transfer of the image data corresponding to the prescribed number of lines. Hence, there is no need to wait for completion of transfer of the image data by the transfer unit, and a time period until starting printing is reduced.

The printing machine may further comprise a reception condition monitoring unit configured to monitor a condition of reception of the image data by the reception unit, wherein the print control unit is configured to drive the printing unit to abort printing and to deliver a print medium out of the printing unit upon judgment of failure of reception of the image data by the reception condition monitoring unit after start of reception of the image data and before completion of the reception.

According to this configuration, when the reception condition monitoring unit judges, after start of reception of the image data, that reception of the image data has failed before completion of reception of the image data corresponding to one sheet, the printing unit is caused to abort printing and the print medium is delivered out from the printing unit. Hence the paper sheet will not remain inside the device, and a user is not bothered by removing of a jammed sheet.

The printing machine may further comprise: a detecting unit configured to detect a leading edge of a print medium to be conveyed from the second paper feeding unit to the printing unit; a paper discharge unit configured to discharge a print medium delivered from the printing unit out of the printing machine; a reversing unit configured to turn over a print medium delivered from the printing unit and to convey the print medium as turned over to the second paper feeding unit; a switching unit configured to guide a print medium delivered from the printing unit to any one of the paper discharge unit and the reversing unit; and a discharge control unit, upon judgment of failure of reception of the image data by the reception condition monitoring unit after start of reception of the image data and before completion of the reception, configured to switch the switching unit to guide a print medium to the paper discharge unit when the leading edge of the print medium is detected by the detecting unit, and to switch the switching unit to guide a print medium to the reversing unit when the leading edge of the print medium is not detected by the detecting unit.

According to this configuration, when the reception condition monitoring unit judges, after start of reception of the image data, that reception of the image data has failed before completion of reception of the data corresponding to one sheet, the switching unit is switched so as to guide the print medium to the paper discharge unit in a case where the leading edge of the print medium is detected by the detection unit, while the switching unit is switched so as to guide the print medium to the reversing unit in a case where the leading edge of the print medium is not detected by the detection unit. Hence it is possible to reuse the print medium if the print medium is reusable. It is also possible to cause the switching unit to perform the switching process depending on detection of the leading edge of the paper sheet by the detection unit and on a lapse of a time period required for the leading edge of the paper sheet to reach the printing unit after detection by the detection unit (a time period calculated by dividing a distance between the detection unit and the printing unit by a conveyance speed). In this case, it is possible to judge whether or not the print medium is reusable more precisely, and thereby to reduce wasting of the print medium.

The printing machine may further comprise: a detecting unit configured to detect a leading edge of a print medium to be conveyed from the second paper feeding unit to the printing unit; a paper discharge unit configured to discharge a print medium delivered from the printing unit out of the printing machine; a reversing unit configured to turn over a print medium delivered from the printing unit and to convey the print medium as turned over to the second paper feeding unit; a switching unit configured to guide a print medium delivered from the printing unit to any one of the paper discharge unit and the reversing unit; and a discharge control unit, upon judgment of failure of reception of the image data by the reception condition monitoring unit after start of reception of the image data and before completion of the reception, configured to switch the switching unit to guide a print medium to the paper discharge unit when the leading edge of the print medium is detected by the detecting unit, and to switch the switching unit to guide a print medium to one of the paper discharge unit and the reversing unit in accordance with a type of the print medium set based on external input when the leading edge of the print medium is not detected by the detecting unit.

According to this configuration, when the reception condition monitoring unit judges, after start of reception of the image data, that reception of the image data has failed before completion of reception of the data corresponding to one sheet, the switching unit is switched so as to guide the print medium to the paper discharge unit in a case where the leading edge of the print medium is detected by the detection unit, while the switching unit is switched so as to guide the print medium to any one of the paper discharge unit and the reversing unit depending on the type of the print medium set up based on the external input in a case where the leading edge of the print medium is not detected by the detection unit. Hence it is possible to reuse the print medium if the print medium is reusable.

The print control unit may be configured to drive the first paper feeding unit to convey only a single print medium upon start of reception of the image data by the reception unit, and control the first paper feeding unit to enable the second paper feeding unit to convey a print medium at a prescribed sheet interval after completion of printing on the conveyed single print medium by the printing unit.

According to this configuration, when the reception unit starts reception of the image data, the first paper feeding unit is caused to convey only a single sheet of the print medium. In addition, the first paper feeding unit is controlled in a way that the second paper feeding unit can convey the print media at a prescribed sheet interval after the printing unit completes printing on the conveyed single printed medium. Hence it is possible to perform printing more stably.

The print control unit may be configured to drive the first paper feeding unit to convey only a single print medium upon start of reception of the image data by the reception unit, and control the first paper feeding unit to enable the second paper feeding unit to convey a print medium at a prescribed sheet interval after completion of transfer of the image data for the single print medium by the transfer unit.

According to this configuration, when the reception unit starts reception of the image data, the first paper feeding unit is caused to convey only a single sheet of the print medium. In addition, the first paper feeding unit is controlled in a way that the second paper feeding unit can convey the print media at a prescribed sheet interval after the transfer unit completes transfer of the image data for the single printed medium. Hence it is possible to perform printing more stably.

DETAILED DESCRIPTION OF THE EMBODIMENT

Embodiments of the present invention will be described with reference to the accompanying drawings.

(First Embodiment)

A first embodiment of the present invention will describe an inkjet printing machine as an example. The inkjet printing machine is configured to execute a printing process in which printing is performed in response to a request from a terminal connected via a network and a copying process in which printing is performed based on an operation of an operating unit by a user.

(Overall Configuration of Printing Machine)

Figure 1:
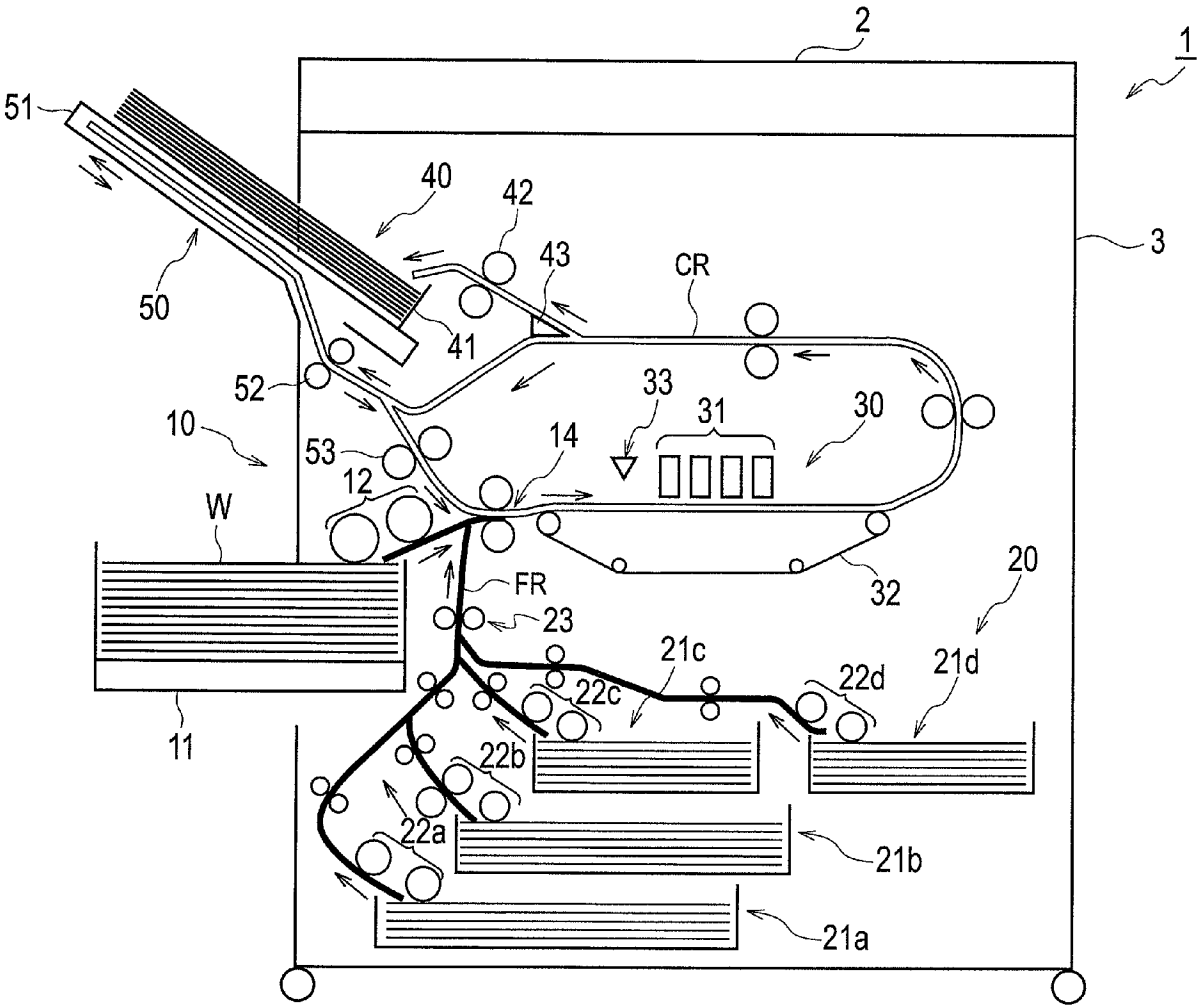
FIG. 1 is an overall configuration diagram showing an overall configuration of a printing machine according to a first embodiment of the present invention.

FIG. 1 is an overall configuration diagram showing an overall configuration of a printing machine 1 according to the first embodiment of the present invention. Arrows illustrated in FIG. 1 explain flow of a print medium.

As shown in FIG. 1, a printing machine 1 includes an image reader 2 and an image forming part 3.

The image reader 2 is provided on the image forming part 3. Although not illustrated, the image reader 2 includes a contact glass used for placing a manuscript thereon, a cover provided attachably to and detachably from this contact glass, a scanning unit configured to scan the manuscript placed on the contact glass, a lens configured to focus a scanned image, and an image processor configured to process a focused image.

The image reader 2 causes the scanning unit to scan the manuscript placed on the contact glass one line at a time, and causes the image processor to process the scanned image, thereby reading the image data to be printed by the image forming part 3.

The image forming part 3 includes a side paper feeder 10, an internal paper feeder 20, a printing unit 30, a paper discharge unit 40, and a reversing unit 50.

The side paper feeder 10 includes a paper feed tray 11 on which print paper sheets W are stacked, a primary paper feeder 12 configured to convey only the topmost print paper sheet W on the paper feed tray 11 onto a paper feed system conveyance path FR, and a secondary paper feeder 14 configured to convey the print paper sheet W conveyed by the primary paper feeder 12 to the printing unit 30. The print paper sheet W conveyed on the paper feed system conveyance path FR by the primary paper feeder 12 comes into contact with the secondary paper feeder 14, whereby a leading edge of the print paper sheet W is aligned and an inclination thereof is corrected. Then, the print paper sheet W is conveyed on a circulation system conveyance path CR to the printing unit 30 at prescribed timing.

The internal paper feeder 20 includes a paper feed tray 21*a* on which print paper sheets W are stacked, a primary paper feeder 22*a* configured to convey only the topmost print paper sheet W on the paper feed tray 21*a* onto the paper feed system conveyance path FR, a paper feed tray 21*b* on which print paper sheets W are stacked, a primary paper feeder 22*b* configured to convey only the topmost print paper sheet W on the paper feed tray 21*b* onto the paper feed system conveyance path FR, a paper feed tray 21*c* on which print paper sheets W are stacked, a primary paper feeder 22*c* configured to convey only the topmost print paper sheet W on the paper feed tray 21*c* onto the paper feed system conveyance path FR, a paper feed tray 21*d* on which print paper sheets W are stacked, and a primary paper feeder 22*d* configured to convey only the topmost print paper sheet W on the paper feed tray 21*d* onto the paper feed system conveyance path FR.

Each of the print paper sheets W conveyed onto the paper feed system conveyance path FR by the primary paper feeders 22*a*, 22*b*, 22*c*, and 22*d* is conveyed on the paper feed system conveyance path FR by multiple conveyance rollers 23 and the like which are disposed on the paper feed system conveyance path FR. Thereafter, the print paper sheet W comes into contact with the secondary paper feeder 14, whereby the leading edge of the print paper sheet W is aligned and an inclination thereof is corrected. Then, the paper sheet W is conveyed on the circulation system conveyance path CR to the printing unit 30 at prescribed timing.

The printing unit 30 includes a head unit 31 incorporating multiple print heads, and an annular conveyance belt 32 provided so as to face the head unit 31. The print paper sheet W fed by the secondary paper feeder 14 is suctioned on the conveyance belt 32 by unillustrated suctioning means disposed inside the annular conveyance belt 32, then conveyed at a speed determined in accordance with a printing condition. Thereafter, printing is performed on the print paper sheet W one line at a time with inks ejected from the head unit 31. Then, the print paper sheet W is discharged. The printing unit 30 includes a top edge sensor 33 configured to detect the leading edge of the print paper sheet W to be conveyed to the head unit 31. The timing for starting printing is adjusted based on detection of the leading edge of the print paper sheet W by the top edge sensor 33.

The print paper sheet W printed by and discharged from the printing unit 30 is conveyed on the circulation system conveyance path CR by use of conveyance rollers and the like disposed on the circulation system conveyance path CR. A switching mechanism 43 is provided on the circulation system conveyance path CR and is configured to switch whether to guide the print paper sheet W conveyed on the circulation system conveyance path CR to the paper discharge unit 40 or to recirculate the print paper sheet W on the circulation system conveyance path CR (to guide the print paper sheet W to the reversing unit 50).

The paper discharge unit 40 includes a paper receiving tray 41 having a tray-like shape protruding from an enclosure of the printing machine 1, and a pair of discharge rollers 42 configured to guide the print paper sheet W to the paper receiving tray 41. Moreover, the print paper sheet W printed by the printing unit 30 is conveyed to the paper receiving tray 41 by the discharge rollers 42 and is stacked on the paper receiving tray 41 with the printed surface facing downward.

The reversing unit 50 includes a reversing tray 51 for reversing the print paper sheet W, and reversing rollers 52 configured to convey the print paper sheet W from the circulation system conveyance path CR to the reversing tray 51 and from the reversing tray 51 to the circulation system conveyance path CR.

The print paper sheet W guided to the reversing unit 50 by the switching mechanism 43 is conveyed from the circulation system conveyance path CR to the reversing tray 51 by the reversing rollers 52, and is conveyed from the reversing tray 51 to the circulation system conveyance path CR after a lapse of a prescribed time period. Hence the print paper sheet W is turned over relative to the circulation system conveyance path CR. Thereafter, the print paper sheet W thus turned over is conveyed on the circulation system conveyance path CR by multiple rollers such as conveyance rollers 53 provided on the circulation system conveyance path CR, and comes into contact the secondary paper feeder 14, whereby the leading edge of the print paper sheet W is aligned and the inclination thereof is corrected. Then, the print paper sheet W is conveyed on the circulation system conveyance path CR to the printing unit 30 at prescribed timing.

(Functional Configuration of Printing Machine)

Figure 2:
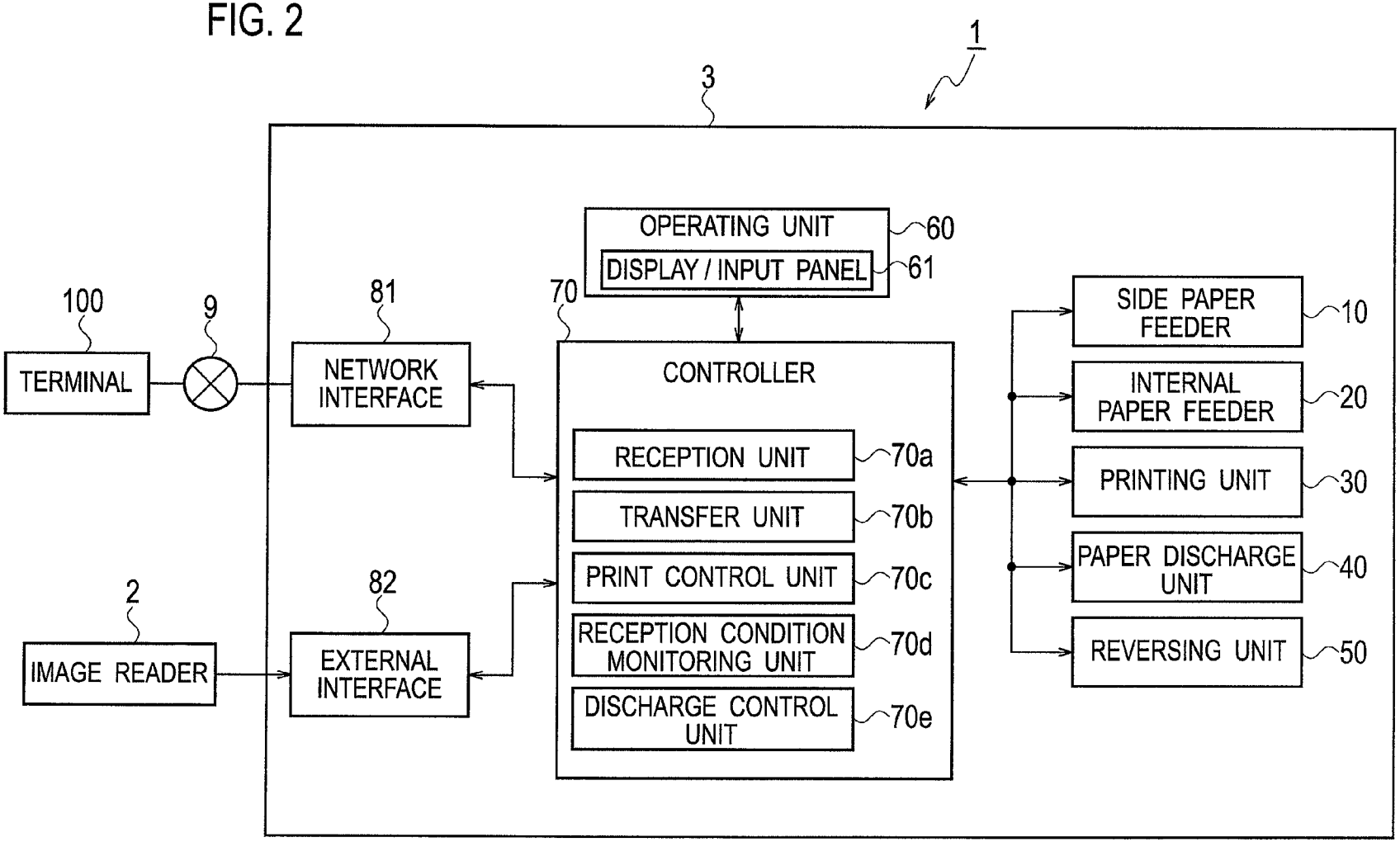
FIG. 2 is a functional configuration diagram showing a functional configuration of the printing machine according to the first embodiment of the present invention.

FIG. 2 is a functional configuration diagram showing a functional configuration of the printing machine 1 according to the first embodiment of the present invention.

As shown in FIG. 2, the printing machine 1 according to the first embodiment of the present invention is connected to a terminal 100 via a network 9.

The terminal 100 generates image data and transmits the generated image data to the printing machine 1 via the network 9 by executing software.

The printing machine 1 includes the image reader 2 and the image forming part 3.

The image forming part 3 includes the side paper feeder 10, the internal paper feeder 20, the printing unit 30, the paper discharge unit 40, the reversing unit 50, an operating unit 60, a controller 70, a network interface 81, and an external interface 82. Among these constituents, the side paper feeder 10, the internal paper feeder 20, the printing unit 30, the paper discharge unit 40, and the reversing unit 50 have already been described, and description thereof will be omitted.

The operating unit 60 is provided in an upper portion of the printing machine 1, and is provided with a display/input panel 61 and various operating keys such as a start key to start reading, printing, and so forth, a stop key to stop reading, printing, and so forth, a numerical keypad to input the number of prints and the like (none of them are shown). The operating unit 60 supplies operating signals based on operations by a user to the controller 70.

The display/input panel 61 of the operating unit 60 includes a transparent touch panel either of a pressure sensitive type or of an electrostatic type disposed on a front surface, and a liquid crystal display panel disposed on a back surface of this touch panel (none of them are shown). The user directly touches the surface of the touch panel with the finger while viewing the display screen of the liquid crystal display panel to perform various setting input operations such as a setting of a one-side printing mode or a two-side printing mode, and setting of types of print paper sheets for the paper feed tray 11 and the paper feed trays 21*a* to 21*d*.

The network interface 81 is a communication interface such as a network card. By connecting the printing machine 1 to the network 9 using this network interface 81, the image data are received from the terminal 100 connected to the network 9, and various signals are transmitted and received.

The external interface 82 is a connection interface with the image reader 2, and supplies the image data read by the image reader 2 to the controller 70.

The controller 70 performs central control of the printing machine 1. From the viewpoints of functions thereof, the controller 70 includes a reception unit 70*a*, a transfer unit 70*b*, a print control unit 70*c*, a reception condition monitoring unit 70*d*, and a discharge control unit 70*e*.

The reception unit 70*a* receives the image data transmitted from the terminal 100 via the network interface 81. The reception unit 70*a* also receives the image data transmitted from the image reader 2 via the external interface 82.

The transfer unit 70*b* transfers the image data received by the reception unit 70*a* to the printing unit 30.

When the reception unit 70*a* starts reception of the image data, the print control unit 70*c* causes the primary paper feeder 12 to start conveyance of the print paper sheet W. When the transfer of the image data corresponding to a prescribed number of lines is completed by the transfer unit 70*b*, the print control unit 70*c* causes the secondary paper feeder 14 to start conveyance of the print paper sheet W. Further, when the reception condition monitoring unit 70*d* judges that the reception of the image data has failed, the print control unit 70*c* aborts printing by the printing unit 30 and causes the printing unit 30 to discharge the print paper sheet W.

The reception condition monitoring unit 70*d* monitors a condition of reception of the image data by the reception unit 70*a*.

In a case where the leading edge of the print paper sheet W is detected by the top edge sensor 33 when the reception condition monitoring unit 70*d* judges that the reception of the image data has failed, the discharge control unit 70*e* switches the switching mechanism 43 so as to guide the print paper sheet W to the paper discharge unit 40. In a case where the tip of the printed sheet W is not detected by the top edge sensor 33 when the reception condition monitoring unit 70*d* judges that the reception of the image data has failed, the discharge control unit 70*e* switches the switching mechanism 43 so as to guide the print paper sheet W to any one of the paper discharge unit 40 and the reversing unit 50 depending on the type of the print paper sheet W set up based on the external input.

(Actions of Printing Machine)

Next, actions of the printing machine 1 according to the first embodiment of the present invention will be described.

The printing machine 1 according to the first embodiment of the present invention mainly performs a print starting process, a copy starting process, and a print monitoring process. The processes will be described below in detail.

(Print Starting Process)

Details of the print starting process in the printing machine 1 according to the first embodiment of the present invention will be described.

Figure 3:
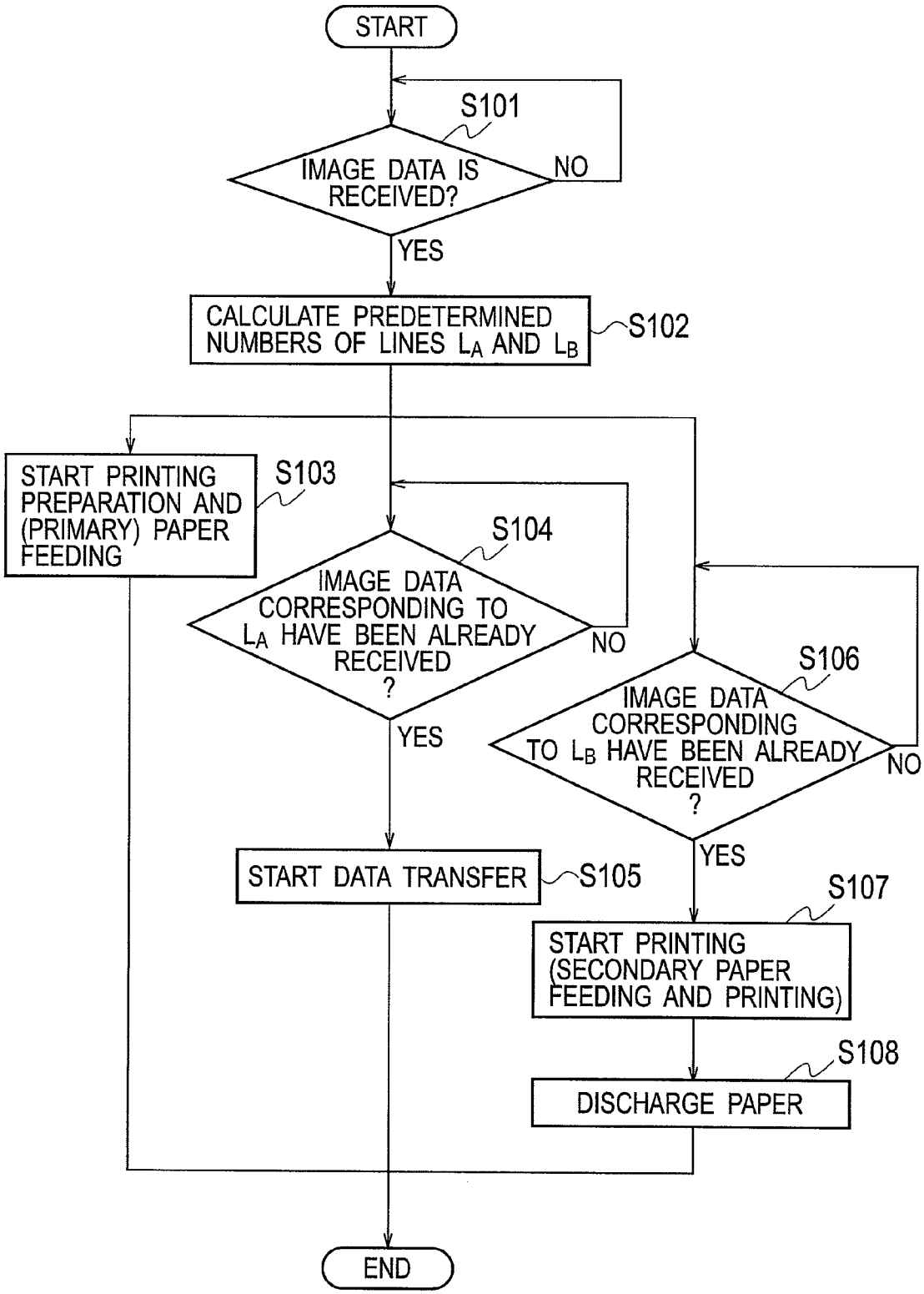
FIG. 3 is a flowchart showing a print starting process in the printing machine according to the first embodiment of the present invention.

FIG. 3 is a flowchart showing the print starting process in the printing machine 1 according to the first embodiment of the present invention. Here, a case of printing an image on the print paper sheet W stacked on the paper feed tray 11 of the side paper feeder 10 will be described as an example.

As shown in FIG. 3, the reception unit 70*a* of the controller 70 judges whether or not the image data transmitted from the terminal 100 via the network 9 are received (step S101). When a judgment is made in step S101 that the image data are received (YES), the controller 70 calculates prescribed numbers of lines $L_A$ and $L_B$ as described below (step S102).

The controller 70 calculates the prescribed number of lines $L_A$ for performing transmission of the image data so that the transfer of the image data from the transfer unit 70*b* to the printing unit 30 does not proceed ahead of the reception of the image data by the reception unit 70*a*. For example, if a reception speed Vr of the image data by the reception unit 70*a* is equal to or faster than a transfer speed Vt of the image data from the transfer unit 70*b* to the printing unit 30, the controller 70 sets the prescribed number of lines $L_A$ to "1". If the reception speed Vr of the image data by the reception unit 70*a* is slower than the transfer speed Vt of the image data from the transfer unit 70*b* to the printing unit 30, the controller 70 calculates the prescribed number of lines $L_A$ by use of the following (formula 1). Here, the number of total lines in the image data is defined as N. As for the number N, if such value is included in header information or the like sent together with the image data, this value may be used. Alternatively, a value estimated from the size of the manuscript included in the header information or the like may be used. In the following (formula 1), ROUNDUP indicates a function to round a numerical value in parenthesis up to the nearest integer. The same applies to (formula 2) to (formula 5) to be described later.

$$L_A = \mathrm{ROUNDUP}[N \times (1 - Vr/Vt)] + 1 \quad \text{(formula 1)}$$

The controller 70 calculates the prescribed number of lines $L_B$ for performing printing so that the printing by the printing unit 30 do not proceed ahead of the transfer of the image data from the transfer unit 70*b* to the printing unit 30 and so that the printing by the printing unit 30 is performed after the printing preparation and the (primary) paper feeding is completed. Firstly, the controller 70 calculates a candidate B1 for the prescribed number of lines. Specifically, if the transfer speed Vt of the image data from the transfer unit 70*b* to the printing unit 30 is equal to or faster than a printing speed Vp by the printing unit 30, the controller 70 sets the candidate B1 for the prescribed number of lines to "$L_A$+1". If the transfer speed Vt of the image data from the transfer unit 70*b* to the printing unit 30 is slower than the printing speed Vp by the printing unit 30, the controller 70 calculates the candidate B1 for the prescribed number of lines by use of the following (formula 2). Here, the number of total lines in the image data is defined as N.

$$B1=\text{ROUNDUP}\{[N\times(1-Vt/Vp)+1]\times Vr/Vt\}+L_A \quad \text{(formula 2)}$$

Next, the controller 70 calculates a candidate B2 for the prescribed number of lines. Specifically, the controller 70 defines a "number obtained by converting a total time period of a time period for the printing preparation and a time period for the (primary) paper feeding into the number of lines in the reception" as the candidate B2 for the prescribed number of lines.

Then, the controller 70 determines a larger one of the calculated candidate B1 for the prescribed number of lines and candidate B2 for the prescribed number of lines as the prescribed number of lines $L_B$.

After step S102, the processing goes to steps S103, S104, or S106.

In step S103, the controller 70 firstly performs the printing preparation. Specifically, the controller 70 causes the paper feed tray 11 on which the print paper sheets W appropriate for the received image data are stacked to be in a state capable of feeding the topmost print paper sheet W, and also performs a process to warm inks, for example. In the case of a printing machine having a structure in which a bottom plate disposed at the bottom inside the paper feed tray is moved vertically in response to a remaining amount of the print paper sheets, the process for causing the paper feed tray 11 to be in a state capable of feeding the topmost print paper sheet W includes a process to lift the tray bottom plate up to a prescribed height so that the print paper sheet can be supplied onto the conveyance path.

After completing the printing preparation, the print control unit 70*c* of the controller 70 causes the primary paper feeder 12 to start paper feeding. Specifically, the print control unit 70*c* causes the primary paper feeder 12 to convey only the topmost print paper sheet W from the paper feed tray 11 onto the paper feed system conveyance path FR. In this way, the print paper sheet W thus conveyed is in contact with the secondary paper feeder 14 after reception of the image data corresponding to the candidate B2 for the prescribed number of lines.

In step S104, the print control unit 70*c* of the controller 70 judges whether or not the image data corresponding to the prescribed number of lines $L_A$ have been received already.

When a judgment is made in step S104 that the image data corresponding to the prescribed number of lines $L_A$ have been received already (YES), the transfer unit 70*b* of the controller 70 starts data transfer of the image data received by the reception unit 70*a* to the printing unit 30 (step S105).

In step S106, the print control unit 70*c* of the controller 70 judges whether or not the image data corresponding to the calculated prescribed number of lines $L_B$ have been received already.

When a judgment is made in step S106 that the image data corresponding to the prescribed number of lines $L_B$ have been received already (YES), the print control unit 70*c* of the controller 70 causes the secondary paper feeder 14 and the printing unit 30 to start the printing process (secondary paper feeding and printing) (step S107). Specifically, in accordance with an instruction given by the print control unit 70*c*, the secondary paper feeder 14 conveys the print paper sheet W in contact therewith onto the circulation system conveyance path CR to the printing unit 30. Thereafter, the print paper sheet W conveyed to the printing unit 30 by the secondary paper feeder 14 is suctioned on the conveyance belt 32, and then subjected to printing one line at a time with the inks ejected from the head unit 31 of the printing unit 30 while being conveyed at the printing speed Vp. Then, the print paper sheet W is delivered. Subsequently, the paper discharge unit 40 discharges the print paper sheet thus delivered (step S108).

Figure 4A:
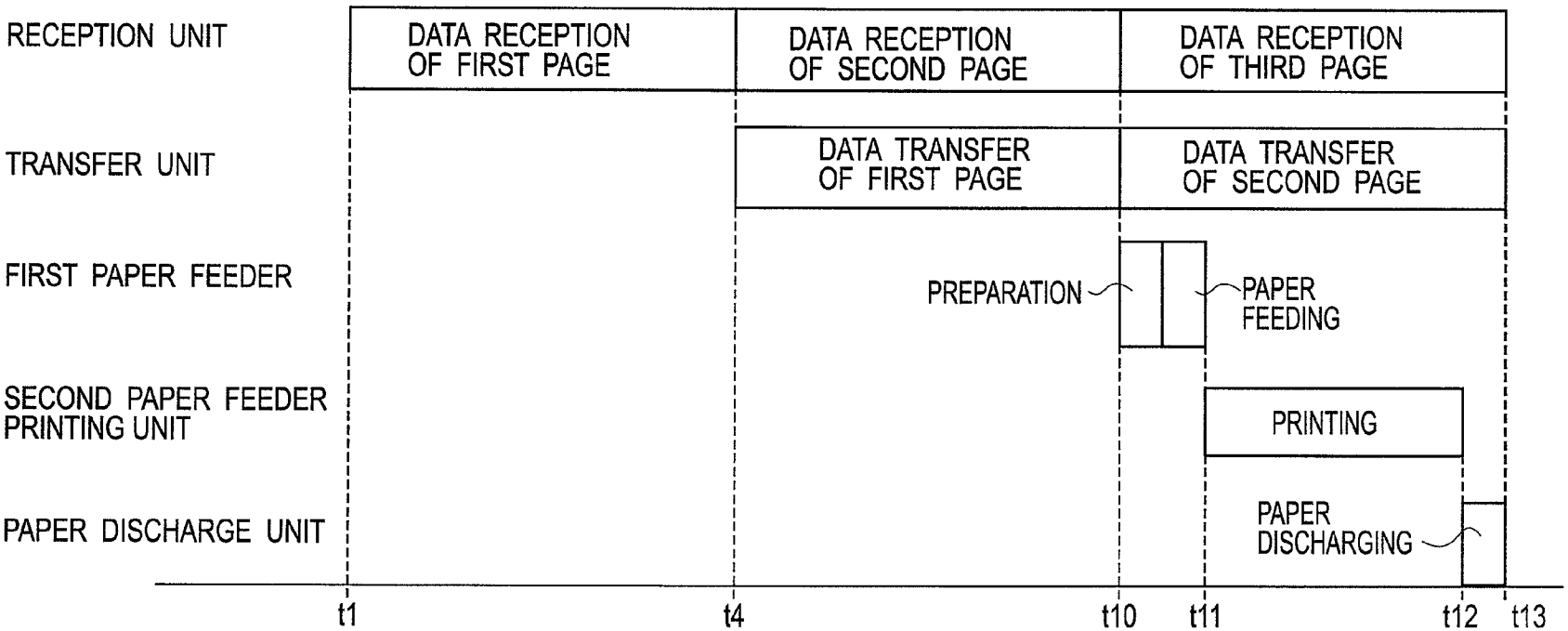
FIG. 4A PRIOR ART
FIG. 4A is a timing chart showing processes from reception of image data to paper discharge in a related art.
Figure 4B:
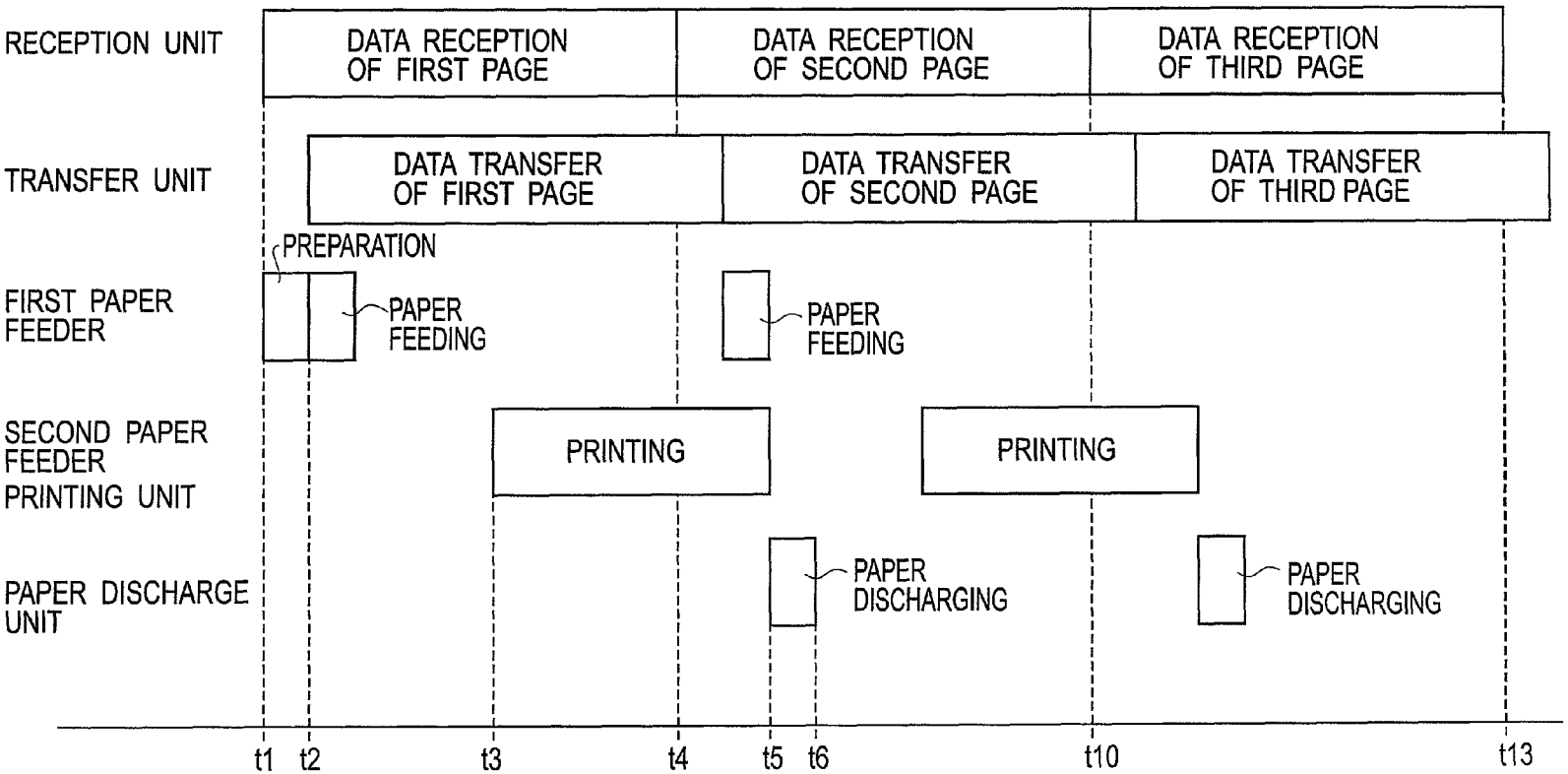
FIG. 4B is a timing chart showing processes from reception of image data to paper discharge by the printing machine in the first embodiment of the present invention.
Figure 5A:
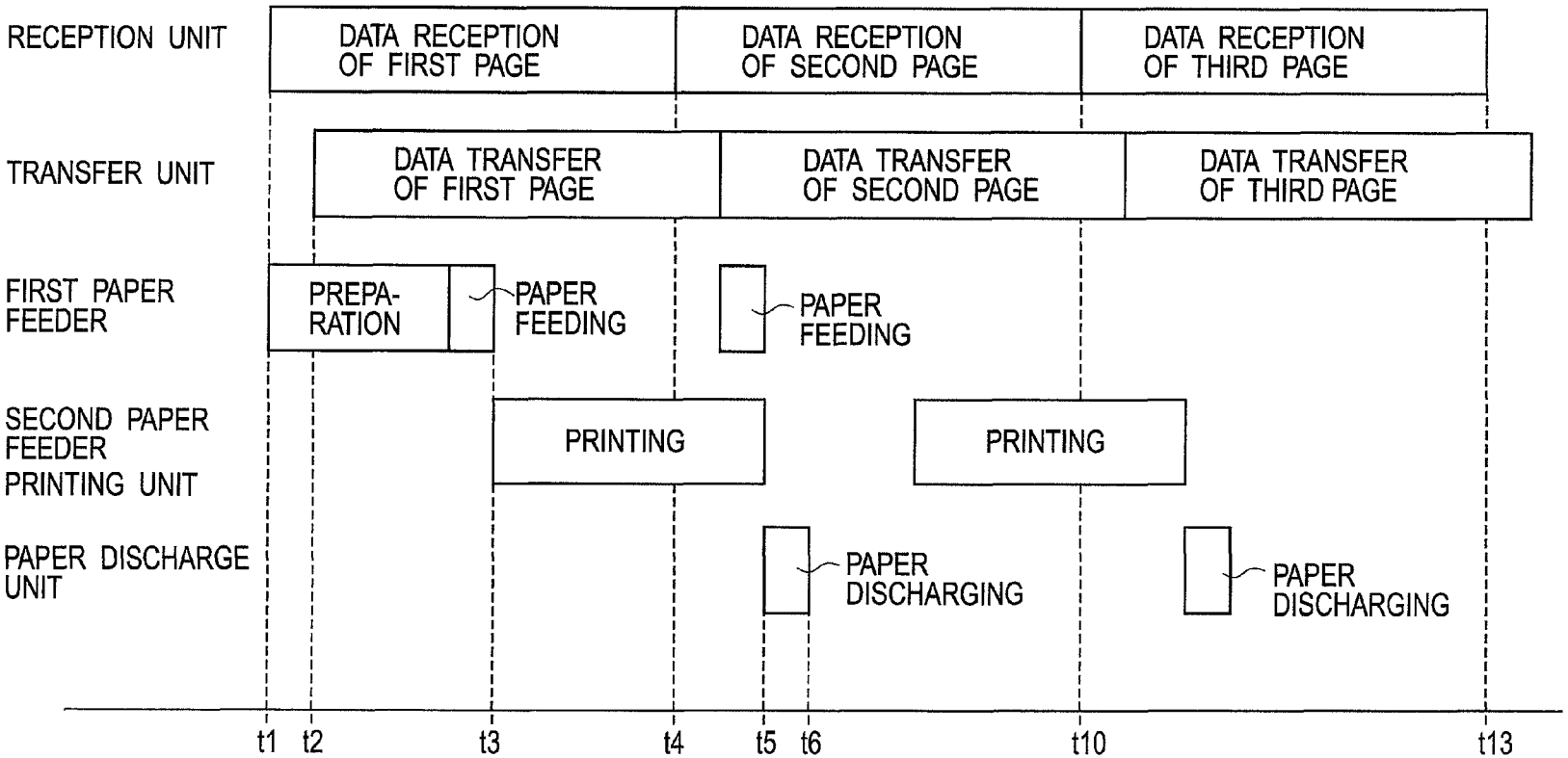
FIGS. 5A and 5B are timing charts showing processes from reception of image data to paper discharge by the printing machine in the first embodiment of the present invention.
Figure 5B:
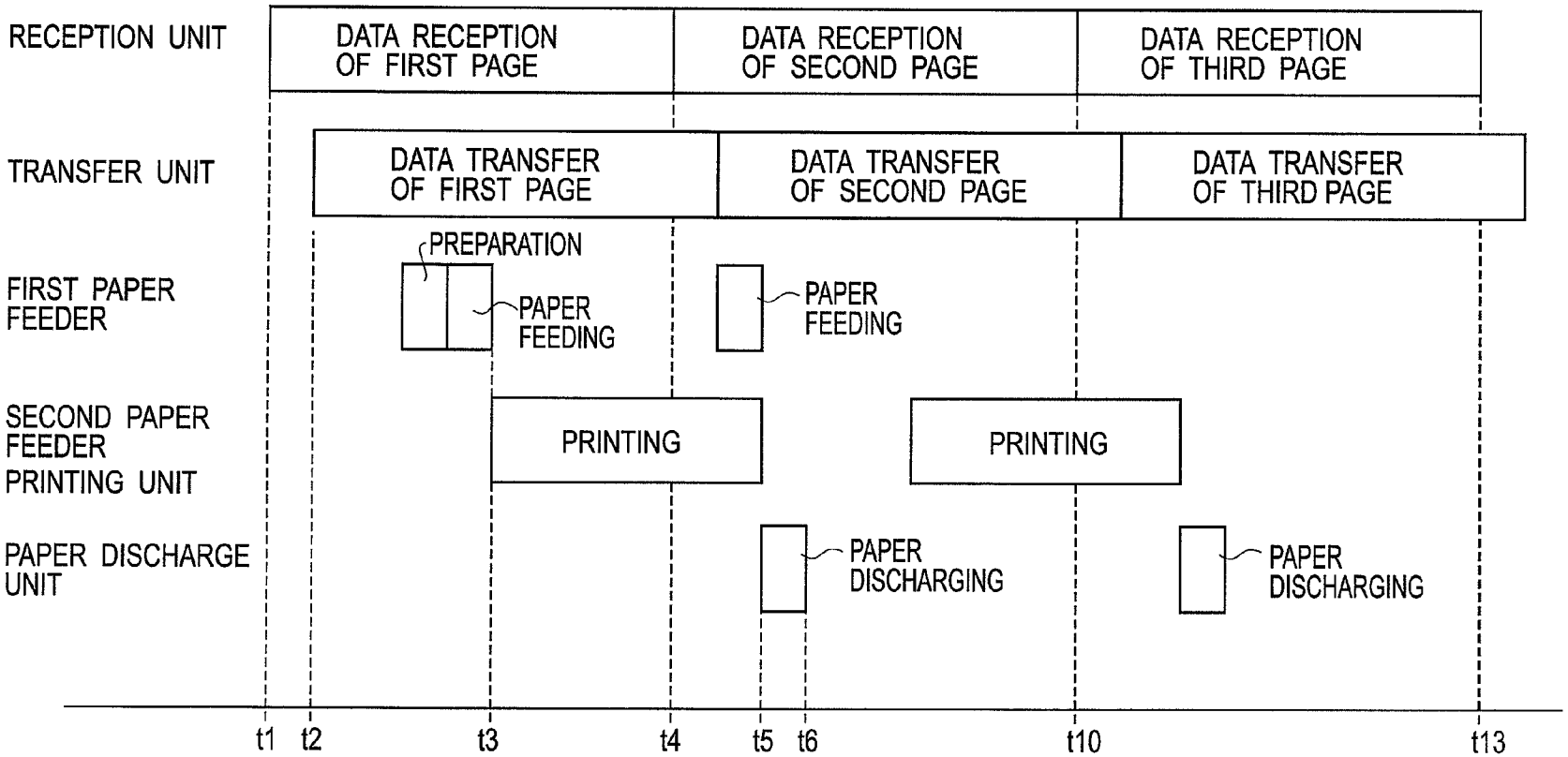

FIG. 4A is a timing chart showing processes from the reception of the image data to the paper discharge in the related art. FIGS. 4B, 5A, and 5B are timing charts showing processes from the reception of the image data to the paper discharge in the printing machine 1 according to the first embodiment of the present invention. FIG. 4B represents a case where the candidate B1 for the prescribed number of lines is greater than the candidate B2 for the prescribed number of lines, while FIG. 5A represents a case where the candidate B1 for the prescribed number of lines is equal to or smaller than the candidate B2 for the prescribed number of lines. A distance from the secondary paper feeder 14 to the printing unit 30 is relatively short, and a time period from a point when the secondary paper feeder 14 starts conveying the print paper sheet W on the circulation system conveyance path CR to the printing unit 30 to a point when the printing unit 30 starts ejecting the inks is relatively short. For this reason, in FIGS. 4A, 4B, and 5A, the secondary paper feeder 14 and the printing unit 30 are illustrated as a single unit for the purpose of simplification. The same applies to FIGS. 5B, 7A, 7B, 9A, 9B, 10A, 10B, 11, and 12 to be described later.

As shown in FIG. 4A, according to the related art, a reception unit starts receiving the image data corresponding to a first page at a time point t1. Then, after completing the reception at a time point t4, a transfer unit of a controller starts the transfer of the image data corresponding to the first page to a printing unit. Then, the printing preparation and the paper feeding are performed after the transfer to the printing unit is completed at a time point t10. Then the printing is started at a time point t11, and the paper discharge is started at a time point t12. Accordingly, a period from the time point t1 to a time point t13 when the paper discharge is completed, i.e., a period until completion of the printing of the first page requires about 8 (seconds), for example.

On the other hand, as shown in FIGS. 4B and 5A, according to the printing machine 1 of first embodiment of the present invention, when the reception unit 70*a* starts receiving the image data corresponding to the first page at a time point t1, the controller 70 causes the primary paper feeder 12 to start the paper feeding after the printing preparation.

Then, after the image data corresponding to the prescribed number of lines $L_A$ are received at a time point t2, the transfer unit 70*b* of the controller 70 starts the transfer of the image data. Thereafter, the printing process is started at a time point t3 after the image data corresponding to the prescribed number of lines $L_B$ are received. Then the paper discharge is started at a time point t5. Accordingly, a period from the time point t1 to a time point t6 when the paper discharge is completed, i.e., a period until completion of the printing of the first page can be reduced to about 6 (seconds), for example. As described above, while the related art requires the time period from the time point t1 to the time point t11 to start the printing, the first embodiment of the present invention only requires the time period from the time point t1 to the time point t3 to start the printing process.

As described above, according to the printing machine 1 of the first embodiment of the present invention, by executing the print starting process, the primary paper feeder 12 is caused to start the conveyance of the print paper sheet W when the reception unit 70*a* starts reception of the image data. Hence it is possible to reduce a time period required until the start of the printing of the first print paper sheet W.

The above-described embodiment is configured to start the printing preparation and the paper feeding immediately after the calculation of the prescribed numbers of lines $L_A$ and $L_B$ (almost right after starting the data reception). However, the present invention is not limited only to this configuration. For example, if the candidate B1 for the prescribed number of lines is greater than the candidate B2 for the prescribed number of lines, as shown in FIG. 5B, the printing preparation and the paper feeding may not be started immediately after the calculation of the prescribed numbers of lines $L_A$ and $L_B$. Instead, the printing preparation and the paper feeding may be started upon receipt of the image data corresponding to the number of lines which is equal to the number obtained by subtracting the candidate B2 for the prescribed number of lines from the candidate B1 for the prescribed number of lines. Then the printing process may be performed subsequent to the completion of the paper feeding. In addition, the calculation methods and the calculation formulae used for the determination of the timing to start the printing process are not limited only to the foregoing.

(Copy Starting Process)

Details of the copy starting process in the printing machine 1 according to the first embodiment of the present invention will be described.

Figure 6:
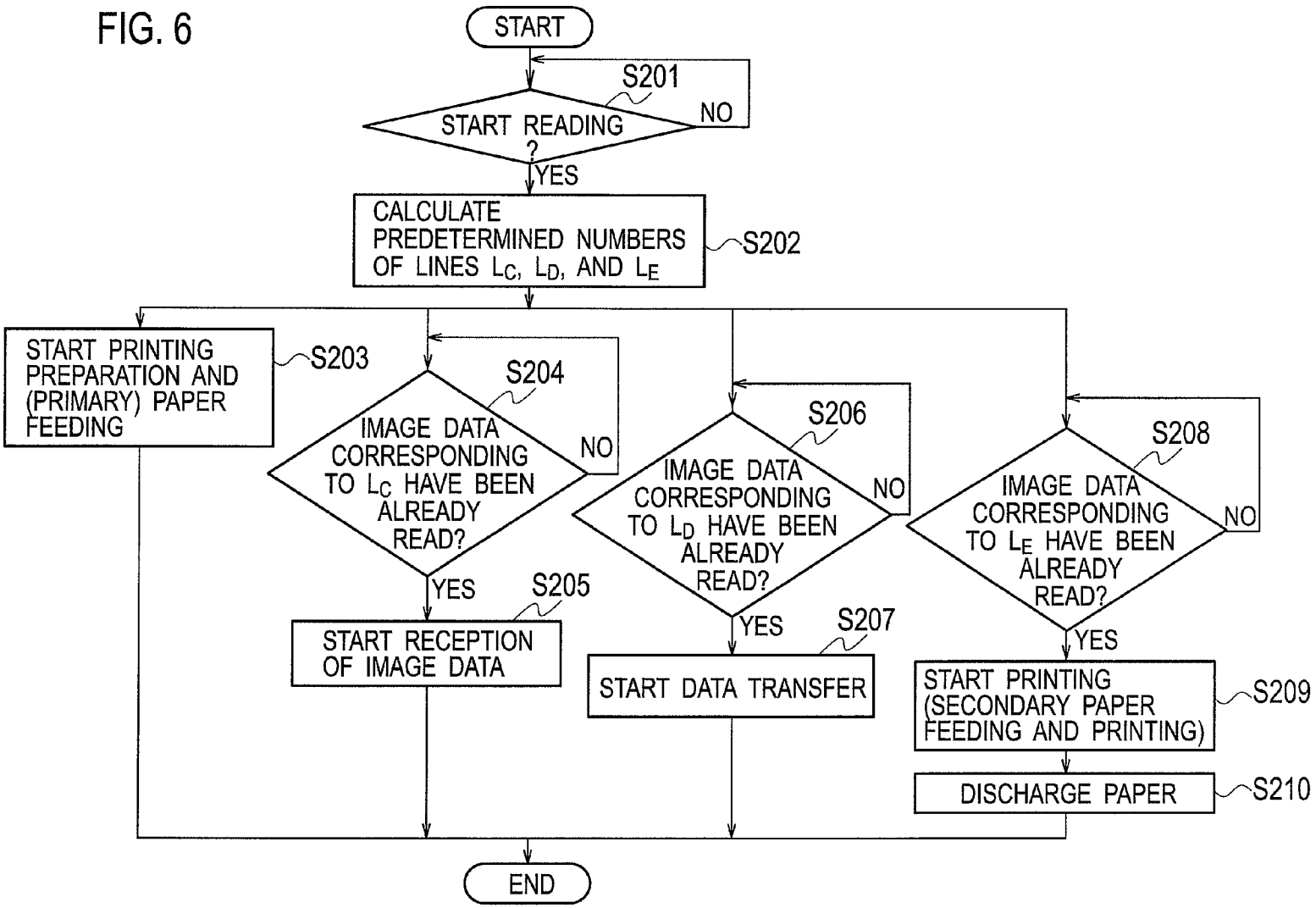
FIG. 6 is a flowchart showing a copy starting process in the printing machine according to the first embodiment of the present invention.

FIG. 6 is a flowchart showing the copy starting process in the printing machine 1 according to the first embodiment of the present invention. Here, a case of printing an image on the print paper sheet W stacked on the paper feed tray 11 of the side paper feeder 10 will be described as an example.

As shown in FIG. 6, the controller 70 judges whether or not the image reader 2 has started reading the image data (step S201). Specifically, the controller 70 judges that the reading has been started, when the user presses down the start key in the operating unit 60 to start the reading.

In the image reader 2, the scanning unit scans the manuscript placed on the contact glass one line at a time, and the image processor processes the scanned image. Thus, the image reader 2 reads the image data to be printed by the image forming part 3. Then a judgment is made whether or not the image data thus read out are supplied to the controller 70 via the external interface 82.

When a judgment is made in step S201 that the reading of the image data is started (YES), the controller 70 calculates prescribed numbers of lines $L_C$, $L_D$, and $L_E$ as described below (step S202).

The controller 70 calculates the prescribed number of lines $L_C$ for reception so that the reception of the image data by the reception unit 70*a* does not proceed ahead of the reading by the image reader 2. For example, if a reading speed Vs of the image reader 2 is equal to or faster than a receiving speed Vr of the image data by the reception unit 70*a*, the controller 70 sets the prescribed number of lines $L_C$ to "1". If the reading speed Vs of the image reader 2 is slower than the receiving speed Vr of the image data by the reception unit 70*a*, the controller 70 calculates the prescribed number of lines $L_C$ by use of the following (formula 3). Here, the number of total lines in the image data is defined as N. The number N may be a value estimated from the size of the manuscript placed on the image reader 2, or may be a value calculated from the size of the paper sheet to be used if the size of the manuscript is undefined and unreadable.

$$L_c = \mathrm{ROUNDUP}[N \times (1 - Vs/Vr)] + 1 \quad \text{(formula 3)}$$

The controller 70 calculates the prescribed number of lines $L_D$ for performing transfer so that the transfer of the image data from the transfer unit 70*b* to the printing unit 30 do not proceed ahead of the reception of the image data by the reception unit 70*a* to the printing unit 30. For example, if the reception speed Vr of the image data by the reception unit 70*a* is equal to or faster than the transfer speed Vt of the image data from the transfer unit 70*b* to the printing unit 30, the controller 70 sets the prescribed number of lines $L_D$ to "$L_C$+1". If the reception speed Vr of the image data by the reception unit 70*a* is slower than the transfer speed Vt of the image data from the transfer unit 70*b* to the printing unit 30, the controller 70 calculates the prescribed number of lines $L_D$ by use of the following (formula 4). Here, the number of total lines in the image data is defined as N.

$$L_D = \mathrm{ROUNDUP}\{[N \times (1 - Vr/Vt) + 1] \times Vs/Vr\} + L_C \quad \text{(formula 4)}$$

The controller 70 calculates the prescribed number of lines $L_E$ for performing printing so that the printing by the printing unit 30 do not proceed ahead of the transfer of the image data from the transfer unit 70*b* to the printing unit 30, and so that the printing by the printing unit 30 is performed after the printing preparation and the (primary) paper feeding is completed.

Firstly, the controller 70 calculates a candidate E1 for the prescribed number of lines. Specifically, if the transfer speed Vt of the image data from the transfer unit 70*b* to the printing unit 30 is equal to or faster than the printing speed Vp by the printing unit 30, the controller 70 sets the candidate E1 for the prescribed number of lines to "$L_C$+LD+1". If the transfer speed Vt of the image data from the transfer unit 70*b* to the printing unit 30 is slower than the printing speed Vp by the printing unit 30, the controller 70 calculates the candidate E1 for the prescribed number of lines by use of the following (formula 5). Here, the number of total lines in the image data is defined as N.

$$E1 = \mathrm{ROUNDUP}\{[N \times (1 - Vt/Vp) + 1] \times Vr/Vt\} + L_C + L_D \quad \text{(formula 5)}$$

Next, the controller 70 calculates a candidate E2 for the prescribed number of lines. Specifically, the controller 70 defines a "number obtained by converting a total time period of a time period for the printing preparation and a time period for the (primary) paper feeding into the number of lines in the reception" as the candidate E2 for the prescribed number of lines.

Then, the controller 70 determines a larger one of the calculated candidate E1 for the prescribed number of lines and candidate E2 for the prescribed number of lines as the prescribed number of lines $L_E$.

After step S202, the processing goes to steps S203, S204, S206, or S208.

In step S203, the controller 70 firstly performs the printing preparation. Specifically, the controller 70 causes the paper feed tray 11 on which the print paper sheets appropriate for the read image data are stacked to be in a state capable of feeding the topmost print paper sheet W, and also performs a process to warm inks, for example. In the case of a printing machine having a structure in which a bottom plate disposed at the bottom inside the paper feed tray is moved vertically in response to a remaining amount of the print paper sheets, the process for causing the paper feed tray 11 to be in a state capable of feeding the topmost print paper sheet W includes a process to lift the tray bottom plate up to a prescribed height so that the print paper sheet can be supplied onto the conveyance path.

After completing the printing preparation, the print control unit 70*c* of the controller 70 causes the primary paper feeder 12 to start paper feeding. Specifically, the print control unit 70*c* causes the primary paper feeder 12 to convey only the topmost print paper sheet W from the paper feed tray 11 onto the paper feed system conveyance path FR. In this way, the print paper sheet W thus conveyed is in contact with the secondary paper feeder 14 after reception of the image data corresponding to the candidate B2 for the prescribed number of lines.

In step S204, the print control unit 70*c* of the controller 70 judges whether or not the image data corresponding to the prescribed number of lines $L_C$ have been read already.

When a judgment is made in step S204 that the image data corresponding to the prescribed number of lines $L_C$ have been read already (YES), the reception unit 70*a* of the controller 70 starts data reception of the image data from the image reader 82 via the external interface 82 (step S205).

In step S206, the print control unit 70*c* of the controller 70 judges whether or not the image data corresponding to the prescribed number of lines $L_D$ have been read already.

When a judgment is made in step S206 that the image data corresponding to the prescribed number of lines $L_D$ have been read already (YES), the transfer unit 70*b* of the controller 70 starts data transfer of the image data received by the reception unit 70*a* to the printing unit 30 (step S207).

In step S208, the print control unit 70*c* of the controller 70 judges whether or not the image data corresponding to the prescribed number of lines $L_E$ have been read already.

When a judgment is made in step S208 that the image data corresponding to the prescribed number of lines $L_E$ have been read already (YES), the print control unit 70*c* of the controller 70 causes the secondary paper feeder 14 and the printing unit 30 to start the printing process (secondary paper feeding and printing) (step S209). Specifically, in accordance with an instruction given by the print control unit 70*c*, the secondary paper feeder 14 conveys the print paper sheet W in contact therewith onto the circulation system conveyance path CR to the printing unit 30. Thereafter, the print paper sheet W conveyed to the printing unit 30 by the secondary paper feeder 14 is suctioned on the conveyance belt 32, and then subjected to printing one line at a time with the inks ejected from the head unit 31 of the printing unit 30 while being conveyed at the printing speed Vp. Then, the print paper sheet W is delivered. Subsequently, the paper discharge unit 40 discharges the print paper sheet thus delivered (step S210).

Figure 7A:
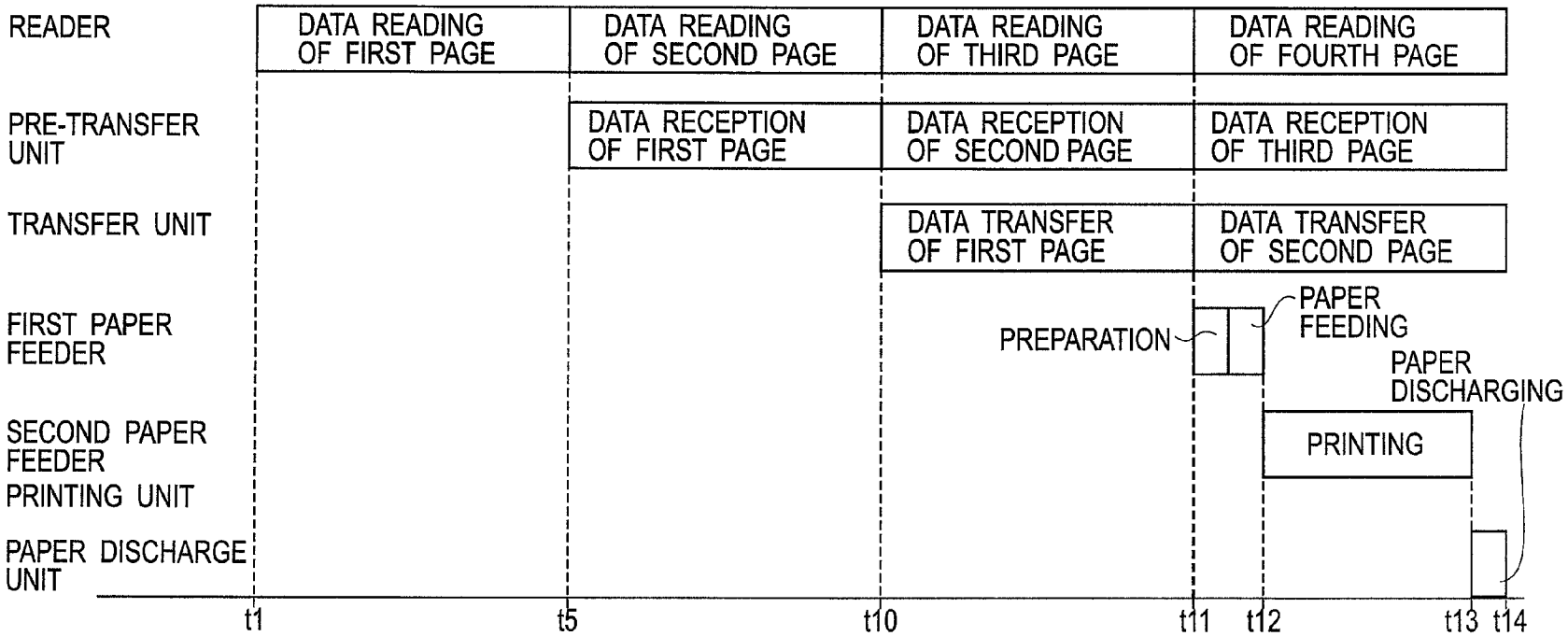
FIG. 7A PRIOR ART
FIG. 7A is a timing chart showing processes from reading of image data to paper discharge in the related art.
Figure 7B:
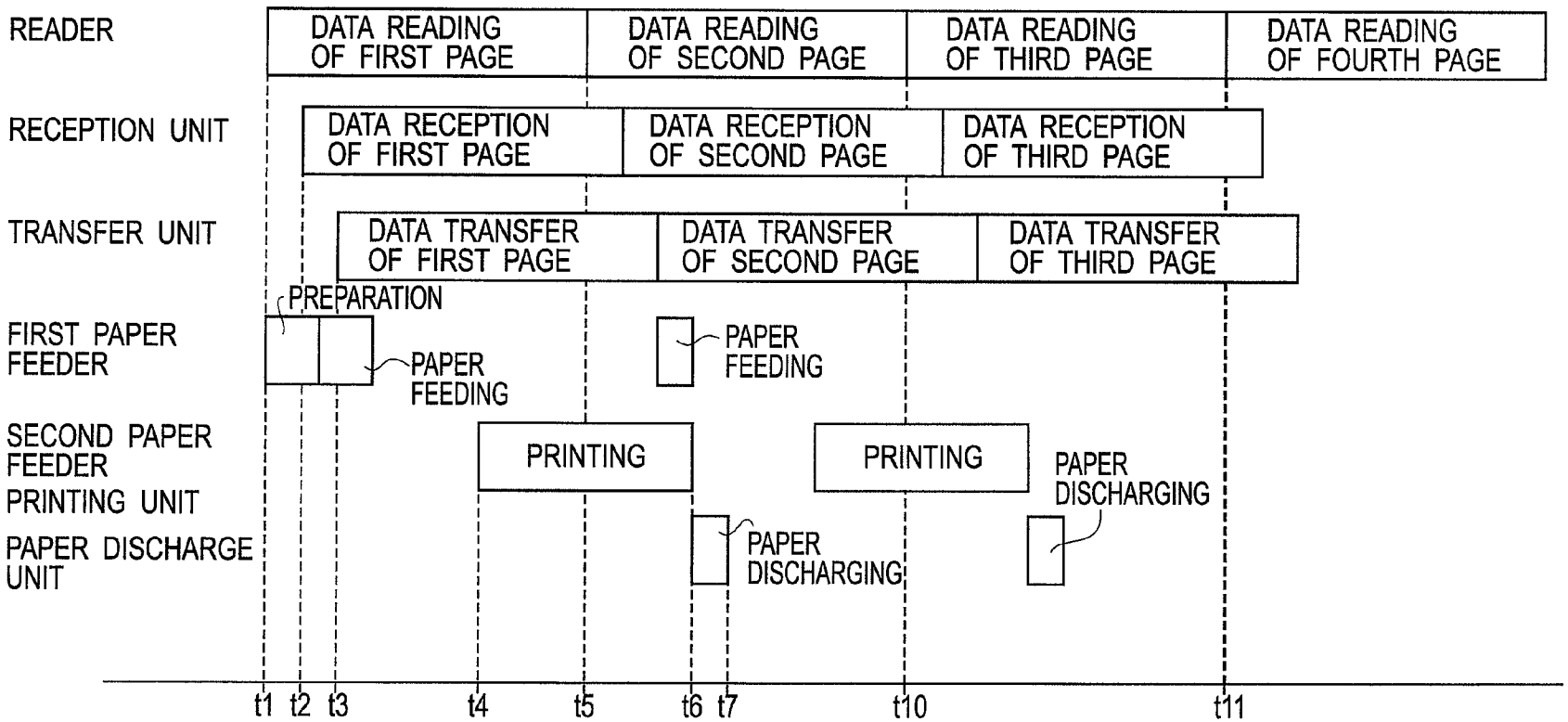
FIG. 7B is a timing chart showing processes from reading of image data to paper discharge in the printing machine according to the first embodiment of the present invention.

FIG. 7A is a timing chart showing processes from the reading of the image data to the paper discharge in the related art. FIG. 7B is a timing chart showing processes from the reading of the image data to the paper discharge in the printing machine 1 according to the first embodiment of the present invention, and is a case where the candidate E1 for the prescribed number of lines is greater than the candidate E2 for the prescribed number of lines. The timing chart of a case where the candidate E1 for the prescribed number of lines is equal to or smaller than the candidate E2 for the prescribed number of lines is conceivably be similar to FIG. 5A that has been described already, and description thereof will be omitted.

As shown in FIG. 7A, according to the related art, the image reader starts reading the image data at a time point t1. Then, after completing the reading at a time point t5, the reception unit starts receiving the image data corresponding to the first page. Then, the transfer unit of the controller starts the transfer of the image data corresponding to the first page to the printing unit at a time point t10. Thereafter, printing preparation and the paper feeding are performed after the transfer to the printing unit is completed at a time point t11. Then the printing process is started at a time point t12, and the paper discharge is started at a time point t13. Here, a period from the time point t1 to a time point t14 when the paper discharge is completed, i.e., a period until completion of the printing of the first page requires about 10 (seconds), for example.

Meanwhile, as shown in FIG. 7B, according to the printing machine 1 of the first embodiment of the present invention, when the reading is started at a time point t1 and the image data corresponding to the prescribed number of lines $L_C$ are read at a time point t2, the reception unit 70*a* starts receiving the image data corresponding to the first page. Moreover, when the reading of the image data is started, the controller 70 causes the primary paper feeder 12 to start the paper feeding after the printing preparation.

Then, after the image data corresponding to the prescribed number of lines $L_D$ are received at a time point t3, the transfer unit 70*b* of the controller 70 starts the transfer of the image data. Thereafter, the printing process is started at a time point t4 after the image data corresponding to the prescribed number of lines $L_E$ are received. Then, the paper discharge is started at a time point t6. Here, a period from the time point t1 to a time point t7 when the paper discharge is completed, i.e., a period until completion of the printing of the first page can be reduced to about 8 (seconds), for example. As described above, while the related art requires the time period from the time point t1 to the time point t12 to start the printing, the first embodiment of the present invention only requires the time period from the time point t1 to the time point t4 to start the printing process.

As described above, according to the printing machine 1 of the first embodiment of the present invention, by executing the copy starting process, the controller 70 performs the printing preparation, and causes the primary paper feeder 12 to start the conveyance of the print paper sheet W when the image reader 2 starts reading of the image data. Hence it is possible to reduce a time period required until the start of the printing of the first print paper sheet W.

The above-described embodiment is configured to start the printing preparation and the paper feeding immediately after the reading the image data. However, the present invention is not limited only to this configuration. For example, if a candidate D1 for the prescribed number of lines is greater than a candidate D2 for the prescribed number of lines, the printing preparation and the paper feeding may not be started immediately after the reading of the image data. Instead, the printing preparation and the paper feeding may be started upon the reading of the image data corresponding to the number of lines which is equal to the number obtained by subtracting the candidate D1 for the prescribed number of lines from the candidate D2 for the prescribed number of lines. Then the printing process may be performed subsequent to the completion of the paper feeding. In addition, the calculation methods and the calculation formulae used for the determination of the timing to start the printing process are not limited only to the foregoing.

(Print Monitoring Process)

Details of the print monitoring process in the printing machine 1 according to the first embodiment of the present invention will be described.

Figure 8:
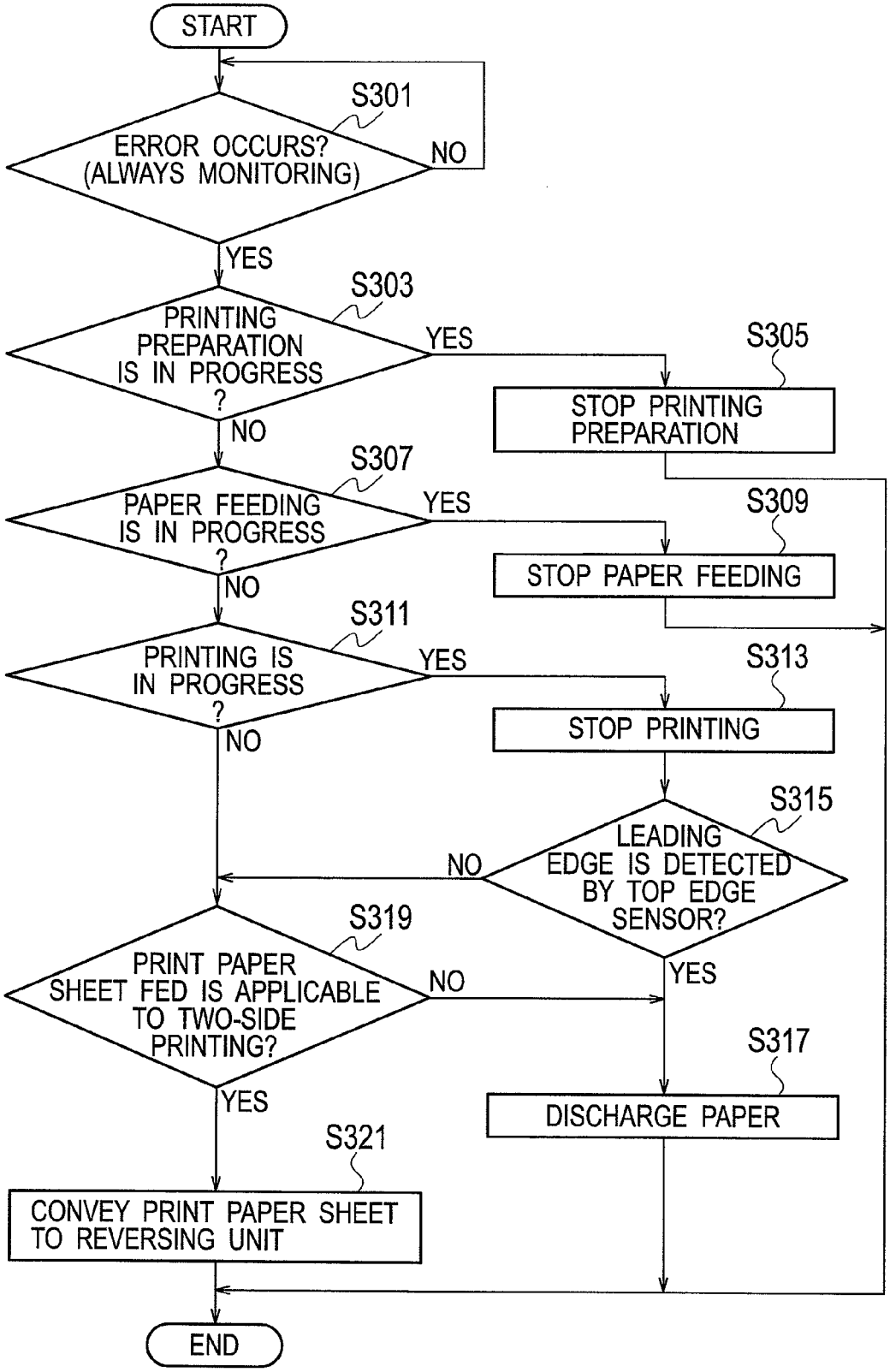
FIG. 8 is a flowchart showing a print monitoring process in the printing machine according to the first embodiment of the present invention.

FIG. 8 is a flowchart showing the print monitoring process in the printing machine 1 according to the first embodiment of the present invention. Here, a case of printing an image on the print paper sheet W stacked on the paper feed tray 11 of the side paper feeder 10 will be described as an example.

As shown in FIG. 8, the reception condition monitoring unit 70*d* of the controller 70 judges whether or not an error occurs in the reception unit 70*a* (step S301). Specifically, the reception condition monitoring unit 70*d* monitors a reception condition of the image data by the reception unit 70*a* and judges whether or not an error code is sent from the reception unit 70*a*.

When a judgment is made in step S301 that an error has occurred in the reception unit 70*a* (YES), the print control unit 70*c* judges whether or not the printing preparation is in progress (step S303).

When a judgment is made in step S303 that the printing preparation is in progress (YES), the print control unit 70*c* aborts the printing preparation (step S305).

On the other hand, when a judgment is made in step S303 that the printing preparation is not in progress (NO), the print control unit 70*c* judges whether or not the paper feeding is in progress (step S307).

When a judgment is made in step S307 that the paper feeding is in progress (YES), the print control unit 70*c* aborts the paper feeding (step S309).

On the other hand, when a judgment is made in step S307 that the paper feeding is not in progress (NO), the print control unit 70*c* judges whether or not the printing is in progress (step S311). Specifically, the print control unit 70*c* judges whether or not the secondary paper feeder 14 has started driving, i.e., whether or not the secondary paper feeder 14 has conveyed the print paper sheet W in contact therewith onto the circulation system conveyance path CR to the printing unit 30.

If a judgment is made in step S311 that the printing is in progress (YES), the print control unit 70*c* aborts the printing and delivers the print paper sheet W from the printing unit 30 (step S313).

Next, the discharge control unit 70*e* of the controller 70 judges whether or not the top edge sensor 33 detects the leading edge of the print paper sheet W conveyed to the head unit 31 (step S315).

When a judgment is made in step S315 that the print paper sheet W is detected (YES), the print paper sheet W is already printed and the paper discharge unit 40 discharges the print paper sheet W delivered from the printing unit 30 out of the printing machine 1 (step S317). Specifically, the switching mechanism 43 guides the print paper sheet W conveyed on the circulation system conveyance path CR to the paper discharge unit 40 based on an instruction by the discharge control unit 70*e*. In this way, the guided print paper sheet W is conveyed to the paper receiving tray 41 by the discharge rollers 42 and is stacked on the paper receiving tray 41 with the printed surface facing downward.

On the other hand, if a judgment is made in step S315 that the print paper sheet W is not detected (NO), the print paper sheet W is yet to be printed and may therefore be reusable.

Accordingly, the discharge control unit 70*e* judges whether or not the print paper sheet W is a print paper sheet applicable to two-side printing (step S319). Specifically, the discharge control unit 70*e* makes the following judgment on the basis of the setting on the type of the print paper sheets, the setting being set up by the user using the display/input panel 61 of the operating unit 60. For example, the discharge control unit 70*e* judges that the print paper sheet W is a print paper sheet applicable to one-side printing in a case of a print paper sheet provided with a special coating only on one surface, such as mat paper, and judges that the print paper sheet W is a print paper sheet applicable to two-side printing in a case of paper processed to have the same quality on both of surfaces, such as ordinary paper.

When a judgment is made in step S319 that the print paper sheet W is a print paper sheet applicable to two-side printing (YES), the print paper sheet W turns out to be reusable.

Accordingly, the reversing unit 50 turns over the print paper sheet W and conveys the print paper sheet W thus turned over to the secondary paper feeder 14 (step S321). Specifically, the switching mechanism 43 guides the print paper sheet W not to the paper discharge unit 40 but to the reversing unit 50 instead on the basis of an instruction by the discharge control unit 70*e*. In this way, the guided print paper sheet W is conveyed from the circulation system conveyance path CR to the reversing tray 51 by way of the reversing rollers 52, and is then conveyed from the reversing tray 51 to the circulation system conveyance path CR after a lapse of a prescribed time period. Hence the print paper sheet W is turned over relative to the circulation system conveyance path CR. Thereafter, the print paper sheet W thus turned over is conveyed on the circulation system conveyance path CR by means of the multiple rollers such as the conveyance rollers 53 provided on the circulation system conveyance path CR, comes into contact with the secondary paper feeder 14, and stands by until the next printing instruction is issued. Then, when the next printing instruction is issued, the print paper sheet W standing by at the secondary paper feeder 14 is fed, and the printing is executed. In this way, when the print paper sheet W is prone to get jammed before reaching the secondary paper feeder 14, it is possible to prevent occurrence of such jam. In addition, the first printed matter can be obtained earlier.

As described above, according to the printing machine 1 of the first embodiment of the present invention, in a case where the print paper sheet W is detected by the top edge sensor 33 when the reception condition monitor unit 70*d* judges that reception of the image data has failed, the switching mechanism 43 is switched so as to guide the print paper sheet W to the paper discharge unit 40. On the other hand, in a case where the print paper sheet W is not detected by the top edge sensor 33, the switching mechanism 43 is switched so as to guide the print paper sheet W to any one of the paper discharge unit 40 and the reversing unit 50 depending on the type of the print paper sheet W set up based on the external input. As a consequence it is possible to reuse the print paper sheet W designed to be reusable.

In the first embodiment of the present invention, in a case where the leading edge the print paper sheet W is not detected by the top edge sensor 33 when the reception condition monitoring unit 70*d* judges that the reception of the image data has failed, the switching mechanism 43 is switched so as to guide the print paper sheet W to any one of the paper discharge unit 40 and the reversing unit 50 depending on the type of the print paper sheet set up based on the external input. However, the present invention is not limited only to this configuration. For example, when the reception condition monitoring unit 70*d* judges that the reception of the image data has failed, the switching mechanism 43 may be switched so as to guide the print paper sheet W to the reversing unit 50 irrespective of the result of detection by the top edge sensor 33.

(Print Starting Process when Two-Side Printing is Set)

When the image data transmitted from the terminal 100 is set to a two-side printing mode, the printing machine 1 according to the first embodiment of the present invention starts printing in the two-side printing mode.

Figure 9A:
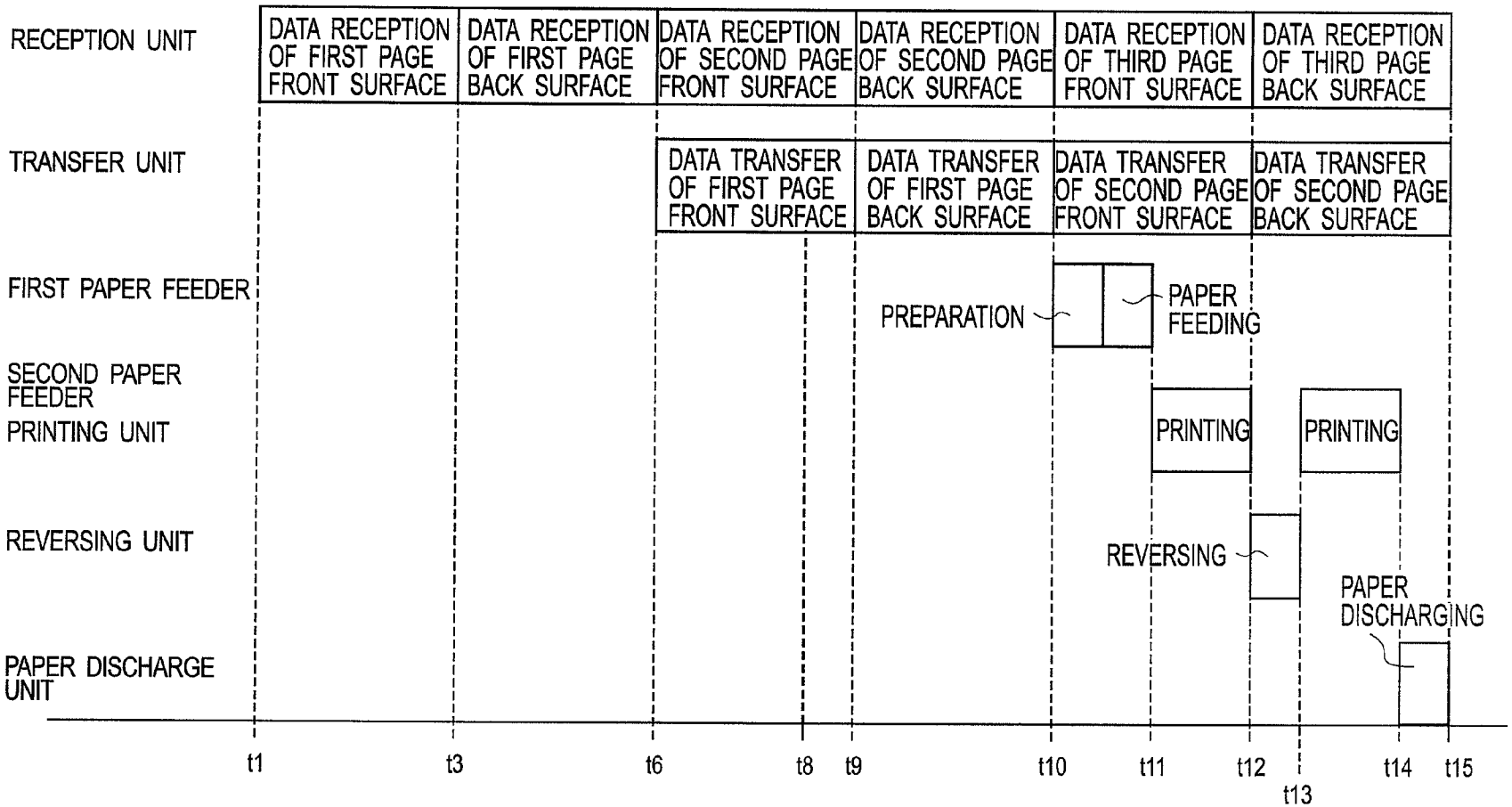
FIG. 9A PRIOR ART
FIG. 9A is a timing chart showing processes from reception of image data to paper discharge in two-side printing in the related art.
Figure 9B:
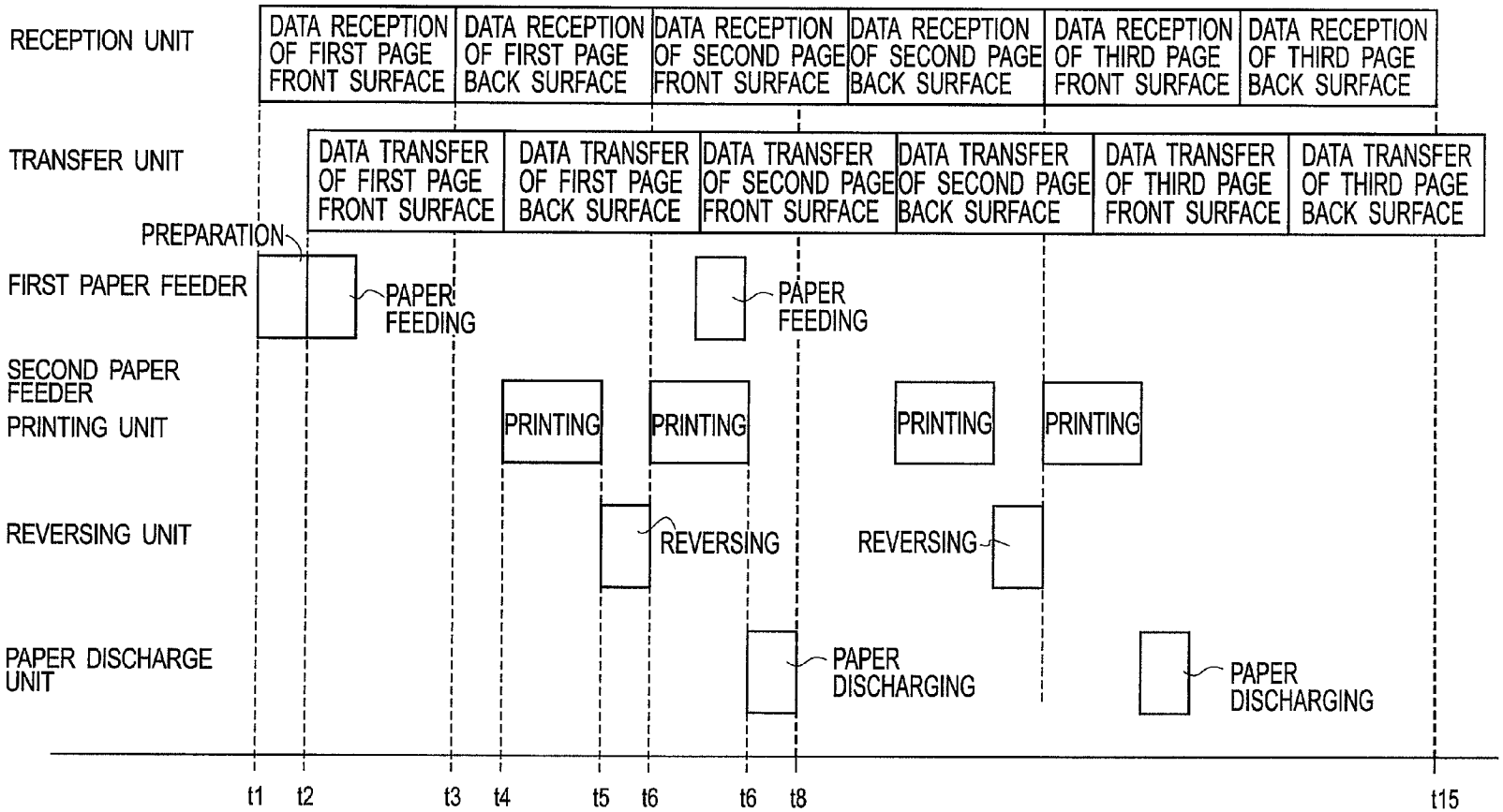
FIG. 9B is a timing chart showing processes from reception of image data to paper discharge in two-side printing by the printing machine according to the first embodiment of the present invention.

FIG. 9A is a timing chart showing processes from the reception of the image data to the paper discharge in the two-side printing in the related art, and FIG. 9B is a timing chart showing processes from the reception of the image data to the paper discharge in the two-side printing by the printing machine 1 according to the first embodiment of the present invention.

As shown in FIG. 9A, according to the related art, when the reception unit starts receiving front surface image data of a first page at a time point t1 and completes reception of the front surface image data at a time point t3, the reception unit starts reception of back surface image data of the first page.

Then, when the reception unit completes reception of the back surface image data at a time point t6, the transfer unit of the controller starts transfer of the front surface image data of the first page to the printing unit. When the transfer of the front surface image data is completed at a time point t9, the transfer unit of the controller starts transfer of the back surface image data of the first page to the printing unit.

Subsequently, after the transfer of the back surface image data to the printing unit is completed at a time point t10, the printing preparation and the paper feeding are performed, and then the printing process of the front surface image data is started at a time point t11. Thereafter, the print paper sheet is turned over at a time point t12. Subsequently, when the turning-over is completed at a time point t13, the printing process of the back surface image data is started. Then, the paper discharge is started when the printing process of the back surface image data is completed at a time point t14. Accordingly, the printing of the first page until completion requires a time period from the time point t1 to a time point t15 when the paper discharge is completed.

On the other hand, as shown in FIG. 9B, according to the printing machine 1 of the first embodiment of the present invention, in the case where the two-side printing mode is set, the controller 70 firstly performs the printing preparation and then causes the primary paper feeder 12 to start the paper feeding when the reception unit 70*a* starts reception of the front surface image data for the first page at a time point t1.

Then, upon receipt of the front surface image data corresponding to the prescribed number of lines $L_A$ at a time point t2, the transfer unit 70*b* of the controller 70 starts the transfer of the image data. Thereafter, when the reception unit 70*a* completes the reception of the front surface image data of the first page at a time point t3, the reception unit 70*a* starts reception of the back surface image data of the first page.

Thereafter, upon receipt of the front surface image data corresponding to the prescribed number of lines $L_B$ at a time point t4, the printing process of the front surface image data is started. Then the print paper sheet is turned over at a time point t5. Subsequently, when the turning-over is completed at a time point t6, the printing process of the back surface image data is started. Next, paper discharge is started as the printing of the back surface image data is completed at a time point t7. Accordingly, it is possible to reduce the time period for completing the printing of the first page to a period from the time point t1 to a time point t8 when the paper discharge is completed.

As described above, while the related art requires the time period from the time point t1 to the time point t11 to start the printing, the first embodiment of the present invention only requires the period from the time point t1 to the time point t4 even in the case where the two-side printing mode is set.

As described above, according to the printing machine 1 of the first embodiment of the present invention, the following effect can be obtained by executing the print starting process even in the case where the two-side printing mode is set. Since the printing preparation is performed and the primary paper feeder 12 is caused to start the conveyance of the print paper sheet W when the reception unit 70*a* starts the reception of the image data, the time period required until the start the printing of the first page of the print paper sheet W can be reduced.

(Copy Starting Process when Two-Side Printing is Set)

As described above, the printing machine 1 according to the first embodiment of the present invention starts copying in the two-side printing mode when the two-side printing mode is set up by the operation of the user using the display/input panel 61.

Figure 10A:
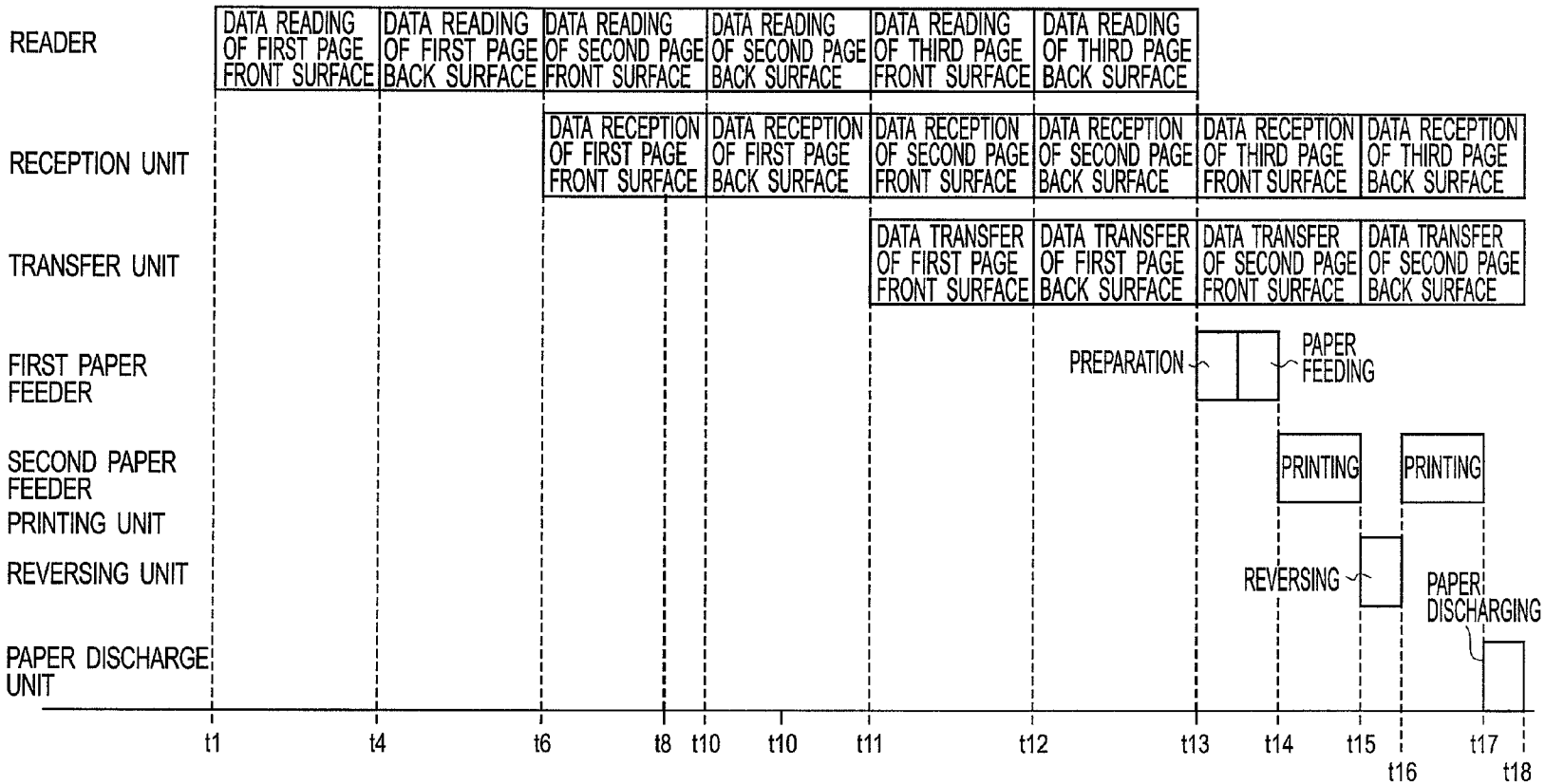
FIG. 10A is a timing chart showing processes from reading of image data to paper discharge in two-side printing in the related art.
Figure 10B:
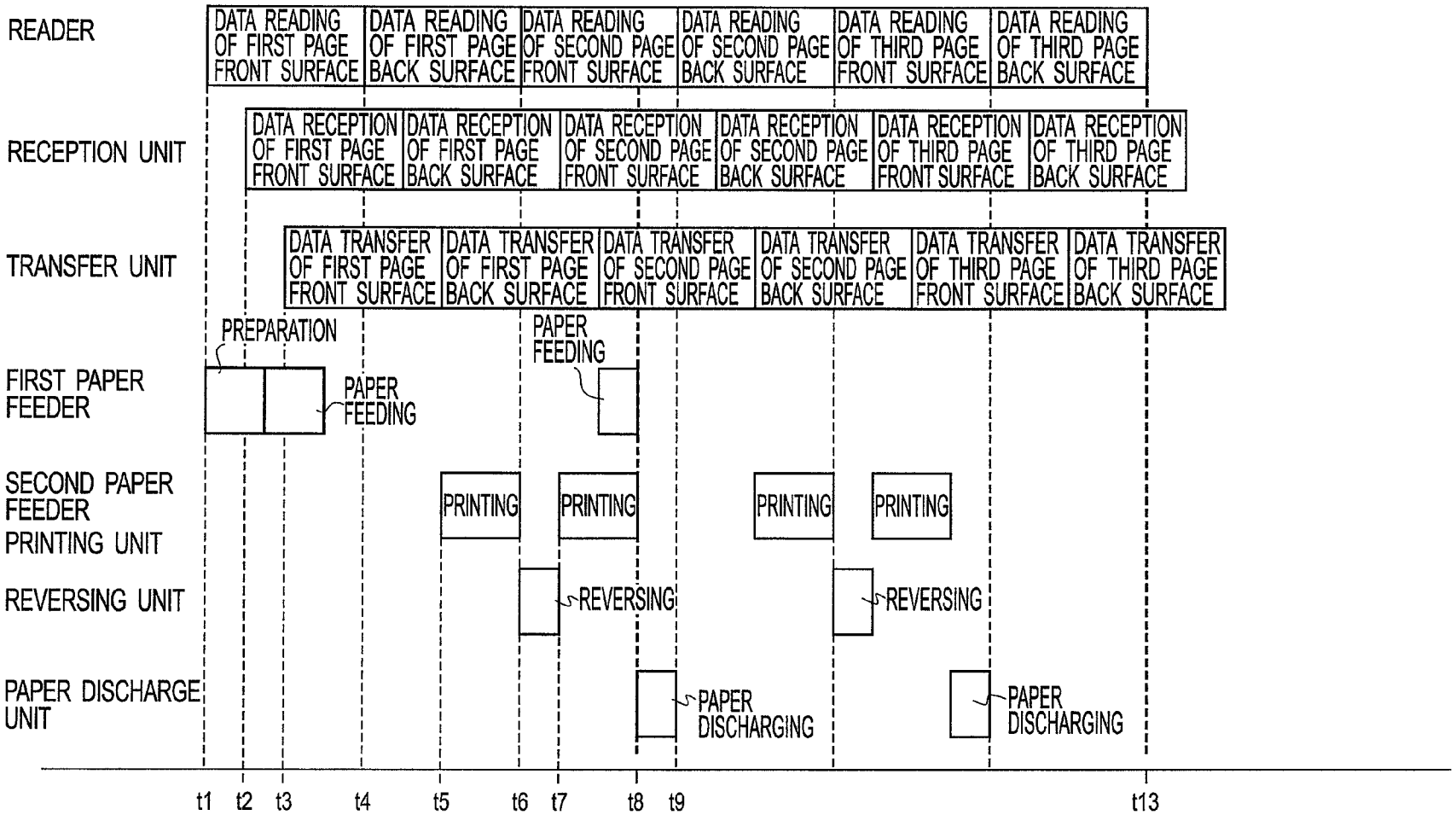
FIG. 10B is a timing chart showing processes from reading of image data to paper discharge in two-side printing by the printing machine according to the first embodiment of the present invention.

FIG. 10A is a timing chart showing processes from the reading of the image data to the paper discharge in the two-side printing in the related art. FIG. 10B is a timing chart showing processes from the reading of the image data to the paper discharge in the two-side printing by the printing machine according to the first embodiment of the present invention, and shows a case where the candidate E1 for the prescribed number of lines is greater than the candidate E2 for the prescribed number of lines.

As shown in FIG. 10A, according to the related art, when the reader starts reading front surface image data of a first page at a time point t1 and completes the reading of the front surface image data at a time point t4, the reader starts reading back surface image data of the first page. Then, when the reading of the back surface image data is completed at a time point t6, the reception unit starts receiving the front surface image data of the first page. When the reception of the front surface image data is completed at a time point t10, reception of the back surface image data of the first page is started.

Subsequently, after the reception of the back surface image data is completed at a time point t11, the transfer unit of the controller starts transfer of the front surface image data of the first page to the printing unit. When the transfer of the front surface image data is completed at a time point t12, the transfer unit of the controller starts transfer of the back surface image data of the first page to the printing unit.

Subsequently, after the transfer of the back surface image data to the printing unit is completed at a time point t13, the printing preparation and the paper feeding are performed, and then the printing process of the front surface image data is started at a time point t14. Thereafter, the print paper sheet is turned over at a time point t15. Subsequently, when the turn-over is completed at a time point t16, the printing process of the back surface image data is started. Then, the paper discharge is started when the printing of the back surface image data is completed at a time point t17. Accordingly, the printing of the first page until completion requires a time period from the time point t1 to a time point t18 when the paper discharge is completed.

Meanwhile, as shown in FIG. 10B, according to the printing machine 1 of the first embodiment of the present invention, in a case where the two-side printing mode is set, the reading is started at a time point t1 and the reception unit 70*a* starts receiving front surface image data of a first page at a time point t2. Moreover, when the reading of the image data is started, the controller 70 causes the primary paper feeder 12 to start the paper feeding after the printing preparation.

Then, after the front surface image data corresponding to the prescribed number of lines $L_D$ are read at a time point t3, the transfer unit 70*b* of the controller 70 starts transfer of the image data.

Thereafter, when the front surface image data corresponding to the prescribed number of lines $L_B$ are read at a time point t5, the printing process of the front surface image data is started. Then the print paper sheet is turned over at a time point t6. Subsequently, when the turning-over of the print paper sheet is completed at a time point t7, the printing process of the back surface image data is started. Next, the paper discharge is started when the printing of the back surface image data is completed at a time point t8. Accordingly, it is possible to reduce the time period for completing printing of the first page to a period from the time point t1 to a time point t9 when the paper discharge is completed.

As described above, while the related art requires the time period from the time point t1 to the time point t14 to start the printing, the first embodiment of the present invention only requires the time period from the time point t1 to the time point t5 to start the printing process even in the case where the two-side printing mode is set.

As described above, according to the printing machine 1 of the first embodiment of the present invention, the following effect can be obtained by executing the copy starting process even in the case where the two-side printing mode is set. Since the controller 70 performs the printing preparation and cause the primary paper feeder 12 to start the conveyance of the print paper sheet W when the image reader 2 starts the reading of the image data, the time period required until the start the printing of the first page of the print paper sheet W can be reduced.

Moreover, the inkjet line color printing machine which performs printing one line at a time has been described as an example of the printing machine 1 according to the first embodiment of the present invention. However, the present invention is not limited only to this example and may be applicable to printing machines of modes such as serial inkjet, laser, and stencil printing.

(Second Embodiment)

In the first embodiment of the present invention, the primary paper feeder 12 is caused to start the conveyance of the print paper sheet W when the reception unit 70*a* starts receiving the image data. However, the present invention is not limited only to this configuration.

A second embodiment of the present invention will describe an example of the printing machine 1 which is configured to cause the primary paper feeder 12 to convey only a single print paper sheet W when the reception unit 70*a* starts receiving the image data, and to control the primary paper feeder 12 in a way that the secondary paper feeder 14 can convey the print paper sheets W at a prescribed sheet interval after the printing unit 30 completes printing on the conveyed single print paper sheet W.

Figure 11:
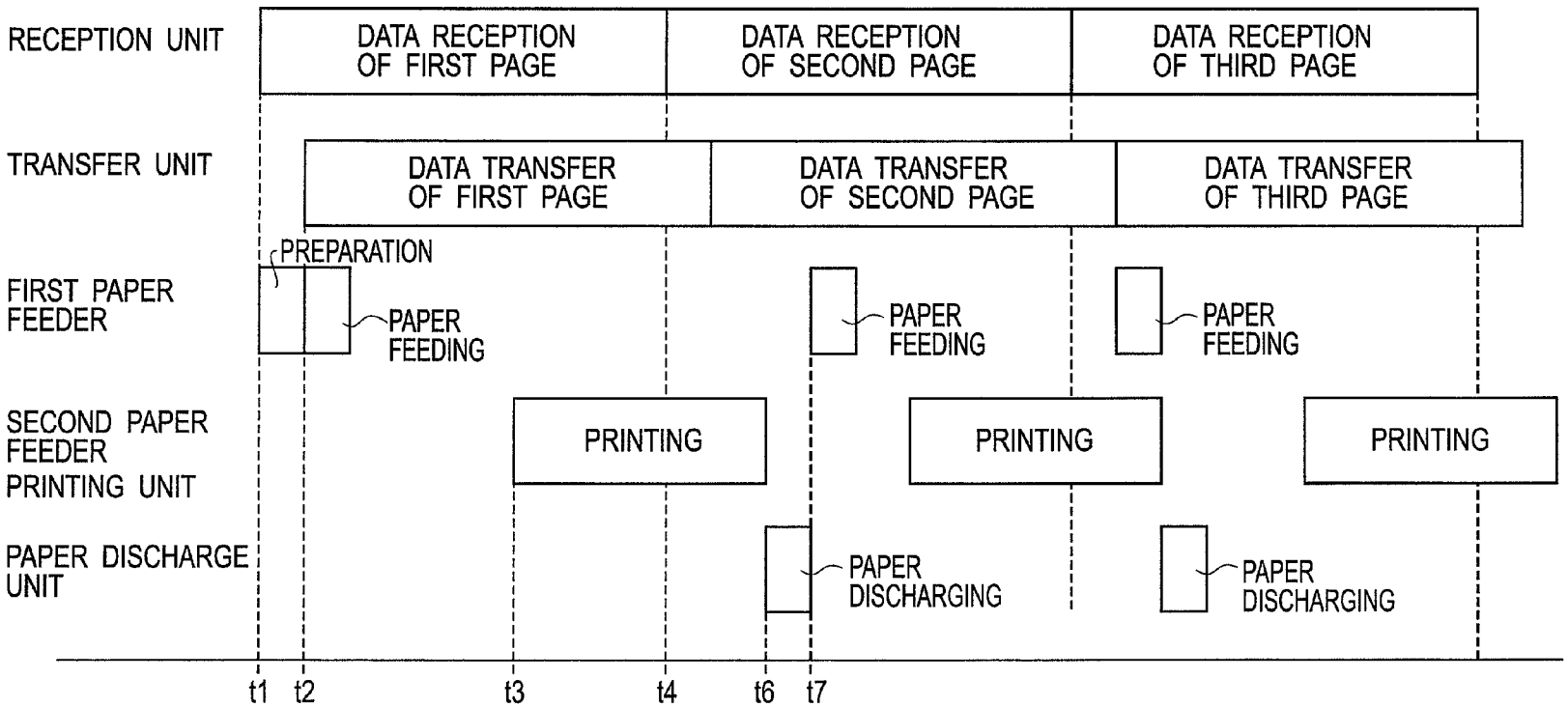
FIG. 11 is a timing chart showing processes from reception of image data to paper discharge in a printing machine according to a second embodiment of the present invention.

FIG. 11 is a timing chart showing processes from reception of image data to paper discharge in a printing machine 1A according to the second embodiment of the present invention.

As shown in FIG. 11, according to the printing machine 1A of the second embodiment of the present invention, when the reception unit 70*a* starts receiving the image data of a first page at a time point t1, the controller 70 performs the printing preparation, and then causes the primary paper feeder 12 to start the paper feeding of a first print paper sheet.

Then, upon receipt of the image data equivalent to the prescribed number of lines $L_A$ at a time point t2, the transfer unit 70*b* of the controller 70 starts transfer of the image data. Meanwhile, the printing process is started at a time point t3 upon receipt of the image data corresponding to the prescribed number of lines $L_B$, and the paper discharge is started at a time point t6. Subsequently, the paper feeding of a second print paper sheet is started after the paper discharge of the first print paper sheet is completed at a time point t7.

Thereafter, concerning a third print paper sheet and so on, the primary paper feeder 12 is caused to start the conveyance of the print paper sheet W in a way that the print paper sheet W can be conveyed at a prescribed sheet interval, i.e., in a way that the secondary paper feeder 14 can convey the print paper sheets W at the prescribed sheet interval when the reception unit 70*a* starts receiving the image data.

As described above, according to the printing machine 1A of the second embodiment of the present invention, the primary paper feeder 12 is caused to convey only a single print paper sheet W, and is controlled in a way that the secondary paper feeder 14 can convey the print paper sheets W at the prescribed sheet interval after the printing unit 30 completes the printing of the conveyed single print paper sheet W. Therefore, the printing process of the second print paper sheet and so on will not be started until the printing process of the first print paper sheet is completed. In this way, it is possible to perform printing more stably.

In the second embodiment of the present invention, the primary paper feeder 12 is caused to convey only a single print paper sheet W when the reception unit 70*a* starts receiving the image data, and is controlled in a way that the secondary paper feeder 14 can convey the print paper sheets W at the prescribed sheet interval after the printing unit 30 completes the printing of the conveyed single print paper sheet W. However, the present invention is not limited only to this configuration. For example, the primary paper feeder 12 may be caused to convey only a single print paper sheet W when the reception unit 70*a* starts receiving the image data, and may be controlled in a way that the secondary paper feeder 14 can convey the print paper sheets W at the prescribed sheet interval after the transfer unit 70*b* completes the transfer of the image data for the single print paper sheet W.

(Third Embodiment)

Figure 12:
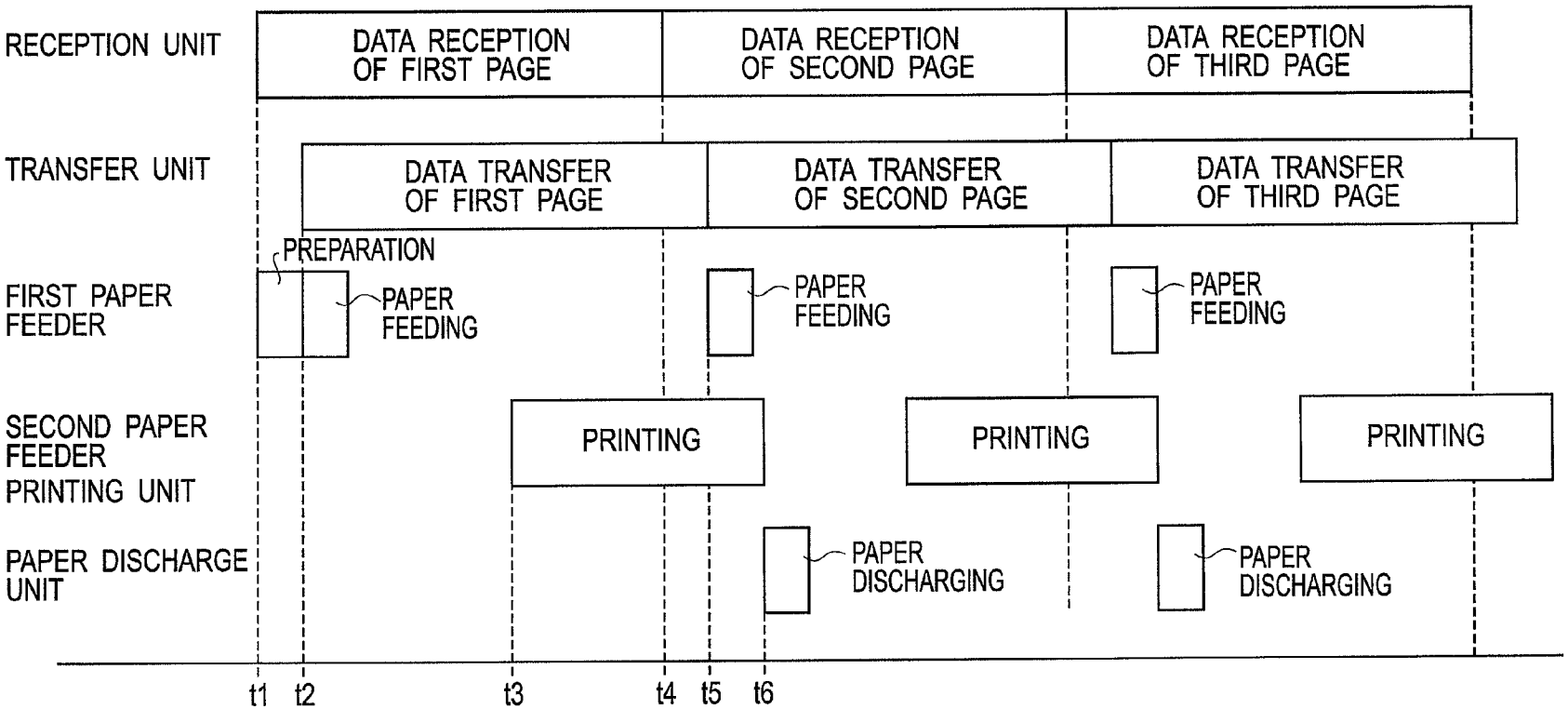
FIG. 12 is a timing chart showing processes from reception of image data to paper discharge in a printing machine according to a third embodiment of the present invention.

FIG. 12 is a timing chart showing processes from reception of image data to paper discharge in a printing machine 1B according to a third embodiment of the present invention.

As shown in FIG. 12, the print control unit 70*c* causes paper feeding of a second print paper sheet to be started at a time point t5 after completion of the transfer of the image data for a first print paper sheet W. Then, the paper discharge of the first print paper sheet is started at a time point t6 upon completion of the printing process of the first print paper sheet.

As described above, according to the printing machine 1B of the third embodiment of the present invention, the primary paper feeder 12 is caused to convey only a single print paper sheet W, and is controlled in a way that the secondary paper feeder 14 can convey the print paper sheets W at the prescribed sheet interval after the transfer unit 70*b* completes transfer of the image data for the single print paper sheet W. Therefore, the printing process of the second print paper sheet and so on will not be started until the transfer of the image data for the first print paper sheet is completed. In this way, it is possible to perform printing more stably.

A printing machine according to the embodiments of the present invention has been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A printing machine comprising:

a reception unit configured to receive image data;

a printing unit configured to print on a print medium based on the image data received by the reception unit;

a first paper feeding unit configured to take out and convey a print medium on a paper feed tray one by one;

a second paper feeding unit configured to convey the print medium conveyed by the first paper feeding unit to the printing unit;

a print control unit configured to drive the first paper feeding unit to start conveyance of a print medium upon start of reception of the image data by the reception unit a reception condition monitoring unit configured to monitor a condition of reception of the image data by the reception unit;

a detecting unit configured to detect a leading edge of a print medium to be conveyed from the second paper feeding unit to the printing unit;

a paper discharge unit configured to discharge a print medium delivered from the printing unit out of the printing machine;

a reversing unit configured to turn over a print medium delivered from the printing unit and to convey the print medium as turned over to the second paper feeding unit;

a switching unit configured to guide a print medium delivered from the printing unit to any one of the paper discharge unit and the reversing unit; and a discharge control unit, upon judgment of failure of reception of the image data by the reception condition monitoring unit after start of reception of the image data and before completion of the reception, configured to switch the switching unit to guide a print medium to the paper discharge unit when the leading edge of the print medium is detected by the detecting unit, and to switch the switching unit to guide a print medium to the reversing unit when the leading edge of the print medium is not detected by the detecting unit.

2. The printing machine according to claim 1, further comprising a transfer unit configured to transfer the image data received by the reception unit to the printing unit, wherein the print control unit is configured to drive the second paper feeding unit to start conveyance of a print medium upon completion of transfer of the image data corresponding to a prescribed number of lines by the transfer unit.

3. The printing machine according to claim 2, wherein the print control unit is configured to drive the first paper feeding unit to convey only a single print medium upon start of reception of the image data by the reception unit, and control the first paper feeding unit to enable the second paper feeding unit to convey a print medium at a prescribed sheet interval after completion of transfer of the image data for the single print medium by the transfer unit.

4. The printing machine according to claim 1, wherein the print control unit is configured to drive the printing unit to abort printing and to deliver a print medium out of the printing unit upon judgment of failure of reception of the image data by the reception condition monitoring unit after start of reception of the image data and before completion of the reception.

5. The printing machine according to claim 1, wherein the print control unit is configured to drive the first paper feeding unit to convey only a single print medium upon start of reception of the image data by the reception unit, and control the first paper feeding unit to enable the second paper feeding unit to convey a print medium at a prescribed sheet interval after completion of printing on the conveyed single print medium by the printing unit.

6. A printing machine comprising:

a reception unit configured to receive image data;

a printing unit configured to print on a print medium based on the image data received by the reception unit;

a first paper feeding unit configured to take out and convey a print medium on a paper feed tray one by one;

a second paper feeding unit configured to convey the print medium conveyed by the first, paper feeding unit to the printing unit;

a print control unit configured to drive the first paper feeding unit to start conveyance of a print medium upon start of reception of the image data by the reception unit;

a reception condition monitoring unit configured to monitor a condition of reception of the image data by the reception unit;

a detecting unit configured to detect a leading edge of a print medium to be conveyed from the second paper feeding unit to the printing unit;

a paper discharge unit configured to discharge a print medium delivered from the printing unit out of the printing machine;

a reversing unit configured to turn over a print medium delivered from the printing unit and to convey the print medium as turned over to the second paper feeding unit;

a switching unit configured to guide a print medium delivered from the printing unit to any one of the paper discharge unit and the reversing unit; and a discharge control unit, upon judgment of failure of reception of the image data by the reception condition monitoring unit after start of reception of the image data and before completion of the reception, configured to switch the switching unit to guide a print medium to the paper discharge unit when the leading edge of the print medium is detected by the detecting unit, and to switch the switching unit to guide a print medium to one of the paper discharge unit and the reversing unit in accordance with a type of the print medium set based on external input when the leading edge of the print medium is not detected by the detecting unit.

7. The printing machine according to claim 6, further comprising a transfer unit configured to transfer the image data received by the reception unit to the printing unit, wherein the print control unit is configured to drive the second paper feeding unit to start conveyance of a print medium upon completion of transfer of the image data corresponding to a prescribed number of lines by the transfer unit.

8. The printing machine according to claim 7, wherein the print control unit is configured to drive the first paper feeding unit to convey only a single print medium upon start of reception of the image data by the reception unit, and control the first paper feeding unit to enable the second paper feeding unit to convey a print medium at a prescribed sheet interval after completion of transfer of the image data for the single print medium by the transfer unit.

9. The printing machine according to claim 6, wherein the print control unit is configured to drive the printing unit to abort printing and to deliver a print medium out of the printing unit upon judgment of failure of reception of the image data by the reception condition monitoring unit after start of reception of the image data and before completion of the reception.

10. The printing machine according to claim 6, wherein the print control unit is configured to drive the first paper feeding unit to convey only a single print medium upon start of reception of the image data by the reception unit, and control the first paper feeding unit to enable the second paper feeding unit to convey a print medium at a prescribed sheet interval after completion of printing on the conveyed single print medium by the printing unit.

* * * * *